US012357895B2

(12) United States Patent
Hsu et al.

(10) Patent No.: US 12,357,895 B2
(45) Date of Patent: Jul. 15, 2025

(54) BICYCLE TRAINER WITH HEIGHT ADJUSTING MEMBER

(71) Applicant: Giant Manufacturing Co. Ltd., Taichung (TW)

(72) Inventors: Hsiao-Wen Hsu, Taichung (TW); Jen-Chieh Huang, Taichung (TW); Chao-Wen Chen, Taichung (TW); Chin-Lai Huang, Taichung (TW); Wen-Hai Lo, Taichung (TW)

(73) Assignee: Giant Manufacturing Co. Ltd., Taichung (TW)

( * ) Notice: Subject to any disclaimer, the term of this patent is extended or adjusted under 35 U.S.C. 154(b) by 121 days.

(21) Appl. No.: 18/173,092

(22) Filed: Feb. 23, 2023

(65) Prior Publication Data

US 2023/0271073 A1 Aug. 31, 2023

Related U.S. Application Data

(60) Provisional application No. 63/313,745, filed on Feb. 25, 2022.

(51) Int. Cl.
*A63B 69/16* (2006.01)
*A63B 21/00* (2006.01)
(Continued)

(52) U.S. Cl.
CPC ..... *A63B 69/16* (2013.01); *A63B 21/0058* (2013.01); *A63B 21/154* (2013.01);
(Continued)

(58) Field of Classification Search
CPC . A63B 22/06; A63B 22/0605; A63B 22/0664; A63B 22/0694; A63B 69/16;
(Continued)

(56) References Cited

U.S. PATENT DOCUMENTS 7,727,124 B1 6/2010 Lassanke et al.
9,999,818 B2 6/2018 Hawkins, III et al.
(Continued)

FOREIGN PATENT DOCUMENTS

CN 204147474 U 2/2015
CN 204522186 U 8/2015
(Continued)

OTHER PUBLICATIONS

Extended European Search Report of the European Patent Office for Application No. 23158508, dated Jul. 26, 2023.
(Continued)

*Primary Examiner* — Zachary T Moore
(74) *Attorney, Agent, or Firm* — Huan-Yi Lin

(57) ABSTRACT

A bicycle trainer includes a base having a base portion and a standing portion, a supporting frame rotationally pivoted on the standing portion of the base around an axle, a cassette module mounted on the supporting frame and having multiple sprockets, and a flywheel module mounted on the supporting frame. A height adjusting member includes the standing portion, the supporting frame and a fixing element. The fixing element is placed in or between the standing portion and the supporting frame for keeping the supporting frame at a predetermined angle with respect to the standing portion.

19 Claims, 21 Drawing Sheets

(51) Int. Cl.
*A63B 21/005* (2006.01)
*A63B 21/22* (2006.01)

(52) U.S. Cl.
CPC ..... *A63B 21/225* (2013.01); *A63B 2069/164* (2013.01); *A63B 2225/093* (2013.01)

(58) Field of Classification Search
CPC ..... A63B 21/154; A63B 21/225; A63B 2069/161; A63B 2069/162; A63B 2069/163; A63B 2069/164; A63B 2069/165
See application file for complete search history.

(56) References Cited

U.S. PATENT DOCUMENTS

| | | | | |
|---|---|---|---|---|
| 10,576,348 | B1 * | 3/2020 | Hawkins, III ..... | A63B 71/0622 |
| 10,933,290 | B2 | 3/2021 | Hawkins, III et al. | |
| 11,260,280 | B2 * | 3/2022 | Papadopoulos ..... | A63B 69/16 |
| 11,383,126 | B2 * | 7/2022 | Xia ..... | A63B 21/0056 |
| 2012/0322621 | A1 | 12/2012 | Bingham, Jr. et al. | |
| 2013/0053223 | A1 * | 2/2013 | Shu-Chiung ..... | A63B 21/0051 482/61 |
| 2014/0171272 | A1 | 6/2014 | Hawkins, III et al. | |
| 2016/0001155 | A1 | 1/2016 | Chung | |
| 2016/0346595 | A1 | 12/2016 | Dalebout et al. | |
| 2023/0145780 | A1 * | 5/2023 | Zapirain Elosegui ..... | A63B 71/023 482/57 |

FOREIGN PATENT DOCUMENTS

| | | | |
|---|---|---|---|
| CN | 107648806 | A | 2/2018 |
| CN | 210170749 | U | 3/2020 |
| EP | 2808064 | A1 | 12/2014 |
| GB | 2463768 | B | 8/2012 |
| JP | 3174536 | U | 3/2012 |
| TW | 202114758 | A | 4/2021 |
| WO | 2002062426 | A1 | 8/2002 |
| WO | 2010134944 | A1 | 11/2010 |
| WO | WO2021041736 | A1 | 3/2021 |

OTHER PUBLICATIONS

Examination Report of the IP Australia for Application No. 2023201124, dated Feb. 19, 2024.
Notice of Reasons of Refusal of the Japan Patent Office for Application No. 2023-027273, dated Apr. 16, 2024.
Canadian Intellectual Property Office (CIPO) First Office Action issued on Jun. 12, 2024, in Canadian application No. 3,191,016, filed on Feb. 24, 2023.
China National Intellectual Property Administration (CNIPA) First Office Action along with Reference List issued on Apr. 30, 2025, in Chinese application No. 202310161453.1, filed on Feb. 24, 2023.
Korean Intellectual Property Office (KIPO) Notice of Preliminary Rejection along with Reference List issued on Oct. 27, 2024, in Korean application No. 10-2023-002441, filed on Feb. 23, 2023.

* cited by examiner

BICYCLE TRAINER WITH HEIGHT ADJUSTING MEMBER

CROSS-REFERENCE TO RELATED INVENTION

This patent application claims the benefit of U.S. Provisional Application No. 63/313,745 filed Feb. 25, 2022 and the disclosure is incorporated herein by reference in its entirety.

BACKGROUND OF THE INVENTION

1. Field of the Invention

The present invention relates to a portable and compact exercise apparatus, in particular to a bicycle trainer with a height adjusting member for a user to be able to exercise anywhere and anytime easily.

2. Description of Related Art

The vertical heights of most conventional trainers are not adjustable or cannot be easily adjusted for bicycles with various wheel sizes, such as 26 or 29 inch wheels.

Patent documents, U.S. Pat. No. 9,999,818 and U.S. Ser. No. 10/933,290, provide a bicycle trainer with a height adjustment bracket (150), as seen in FIG. 1, which is coupled between the main frame member (128) and the center leg (112). The center leg (112) defines a plurality of apertures (152) along its length that are configured to receive a pin (154) that extends through the opposing member apertures and one of the pluralities of apertures (152) in the center leg (112). By fixing the height adjustment bracket (150) with one of the plurality of apertures (152) along the center leg (112), a user can raise or lower the main member (128) thereby raising or lowering the axle to which the bicycle is mounted.

However, as one can observe from FIG. 1, the bicycle trainer is not compact enough and it is hard for the user to apply lifting force through the height adjustment bracket (150) by one hand while aligning the pin (154) with the corresponding apertures of the center leg (112) and height adjustment bracket (150) by the other hand. In addition, when the user want to fix the height adjustment bracket (150) with another aperture (152), the user's fingers are very close to a sharp angle formed by the height adjustment bracket (150) and the center leg (112) which might cause injury to the user's fingers.

Accordingly, it is desired to have another bicycle trainer with a height adjusting member, in particular to another bicycle trainer with a height adjusting member supporting an axle and cassette where a rider can mount his/her own bicycle without its rear wheel.

SUMMARY OF THE INVENTION

In view of the deficiency of the conventional trainers, the present application provides a bicycle trainer designed to be safer, portable and compact. The bicycle trainer has various features including height adjustment, tension adjustment, optional magnetic poles, power charge, and communication, such as with a smart device or tablet, among other features and advantages.

In one aspect of the present invention, the bicycle trainer comprises a base having a base portion and a standing portion; at least one leg pivotally mounted on the base; a supporting frame rotationally pivoted on the standing portion of the base around an axle; a cassette module mounted on the supporting frame and having multiple sprockets; a flywheel module mounted on the supporting frame and being coaxial with the cassette module around an axle; and a height adjusting member, comprising the standing portion, the supporting frame and a fixing element, and the fixing element is placed in or between the standing portion and the supporting frame for keeping the supporting frame at a predetermined angle with respect to the standing portion.

In another aspect of the present invention, the fixing element is a locating pin, and wherein the standing portion has at least one aligning hole and the supporting frame has multiple locating holes, and wherein the at least one aligning hole and one of the multiple locating holes can receive the locating pin to keep the supporting frame at a predetermined angle with respect to the standing portion.

In yet another aspect of the present invention, the bicycle trainer further comprises a knob at one end of the locating pin.

In yet another aspect of the present invention, the standing portion has one aligning hole at one side of the standing portion and further has another aligning hole at the other side of the standing portion, and wherein the aligning holes and one of the multiple locating holes can receive the locating pin to keep the supporting frame at a predetermined angle with respect to the standing portion.

In yet another aspect of the present invention, the fixing element is a pawl pivoted on the supporting frame, and wherein the standing portion has a ratchet part and the supporting frame has a spring coupled to the pawl, and wherein the pawl can engage with a teeth of the ratchet part to keep the supporting frame at a predetermined angle with respect to the standing portion.

In yet another aspect of the present invention, the bicycle trainer further comprises a handle disposed at or near the top of the bicycle trainer when the bicycle trainer is in a folded mode.

In yet another aspect of the present invention, the bicycle trainer further comprises an electrical power source accommodated in the base and used to power up electrical components in the bicycle trainer.

In yet another aspect of the present invention, the flywheel module further comprises a dual mode motor simulating uphill and downhill cycling circumstance.

In one aspect of the present invention, the bicycle trainer comprises a base having a base portion and a standing portion; at least one leg pivotally mounted on the base; a supporting frame rotationally pivoted on the standing portion of the base around a first axle; a cassette module mounted on the supporting frame and having multiple sprockets and a cassette pulley, the cassette module rotates around a second axle; a flywheel module mounted on the supporting frame and having a flywheel pulley, wherein the flywheel module rotates around the first axle; a belt being around the cassette pulley and the flywheel pulley; and a height adjusting member, comprising the standing portion, the supporting frame and a fixing element, and wherein the fixing element is placed in or between the standing portion and the supporting frame for keeping the supporting frame at a predetermined angle with respect to the standing portion.

In yet another aspect of the present invention, the fixing element is a locating pin, and wherein the standing portion has at least one aligning hole and the supporting frame has multiple locating holes, and wherein the aligning hole and one of the multiple locating holes can receive the locating pin to keep the supporting frame at a predetermined angle with respect to the standing portion.

In yet another aspect of the present invention, the bicycle trainer further comprises a knob at one end of the locating pin.

In yet another aspect of the present invention, the standing portion has one aligning hole at one side of the standing portion and further has another aligning hole at the other side of the standing portion, and wherein the aligning holes and one of the multiple locating holes can receive the locating pin to keep the supporting frame at a predetermined angle with respect to the standing portion.

In yet another aspect of the present invention, the fixing element is a pawl pivoted on the supporting frame, and wherein the standing portion has a ratchet part and the supporting frame has a spring coupled to the pawl, and wherein the pawl can engage with a teeth of the ratchet part to keep the supporting frame at a predetermined angle with respect to the standing portion.

In yet another aspect of the present invention, the bicycle trainer further comprises a handle disposed at or near the top of the bicycle trainer when the bicycle trainer is in a folded mode.

In yet another aspect of the present invention, the bicycle trainer further comprises an electrical power source accommodated in the base and used to power up electrical components in the bicycle trainer.

In yet another aspect of the present invention, the flywheel module further comprises a magnetic resistance component simulating uphill cycling circumstance.

In yet another aspect of the present invention, the base is a one-piece base.

In yet another aspect of the present invention, the bicycle trainer further comprises a belt tension arm pivoted around the axle, an idler pulley pivoted on the belt tension arm and a spring, and one end of the spring is connected to one end of the belt tension arm and the other end of the spring is connected to a housing of the supporting frame, and wherein a tension of the belt is automatically increased or decreased in response to an angle formed between the supporting frame and the standing portion.

In yet another aspect of the present invention, the flywheel pulley, the belt tension arm, the supporting frame and the flywheel module are rotationally co-pivoted around the axle.

In one aspect of the present invention, the exercise apparatus comprises a base having a base portion and a standing portion; a supporting frame rotationally pivoted on the standing portion of the base around a first axle; a flywheel module pivotally mounted on the supporting frame around a second axle for simulating uphill and/or downhill cycling circumstance; and a height adjusting member comprising the standing portion, the supporting frame and a fixing element, and wherein the fixing element is placed in or between the standing portion and the supporting frame for keeping the supporting frame at a predetermined angle with respect to the standing portion.

BRIEF DESCRIPTION OF THE DRAWINGS

In order to sufficiently understand the essence, advantages and the preferred embodiments of the present invention, the following detailed description will be more clearly understood by referring to the accompanying drawings.

DETAILED DESCRIPTION OF THE INVENTION

The following description shows the preferred embodiments of the present invention. The present invention is described below by referring to the embodiments and the figures. Thus, the present invention is not intended to be limited to the embodiments shown, but is to be accorded the principles disclosed herein. Furthermore, that various modifications or changes in light thereof will be suggested to persons skilled in the art and are to be included within the spirit and purview of this application and scope of the appended claims.

In some figures, for example FIGS. 3, 5, 8, 13, 16, 17, 19 and 21, the profile lines of some elements which should be covered by other elements and unseen are still illustrated for indicating their positions relating to other elements.

The First Embodiment

Figure 1:
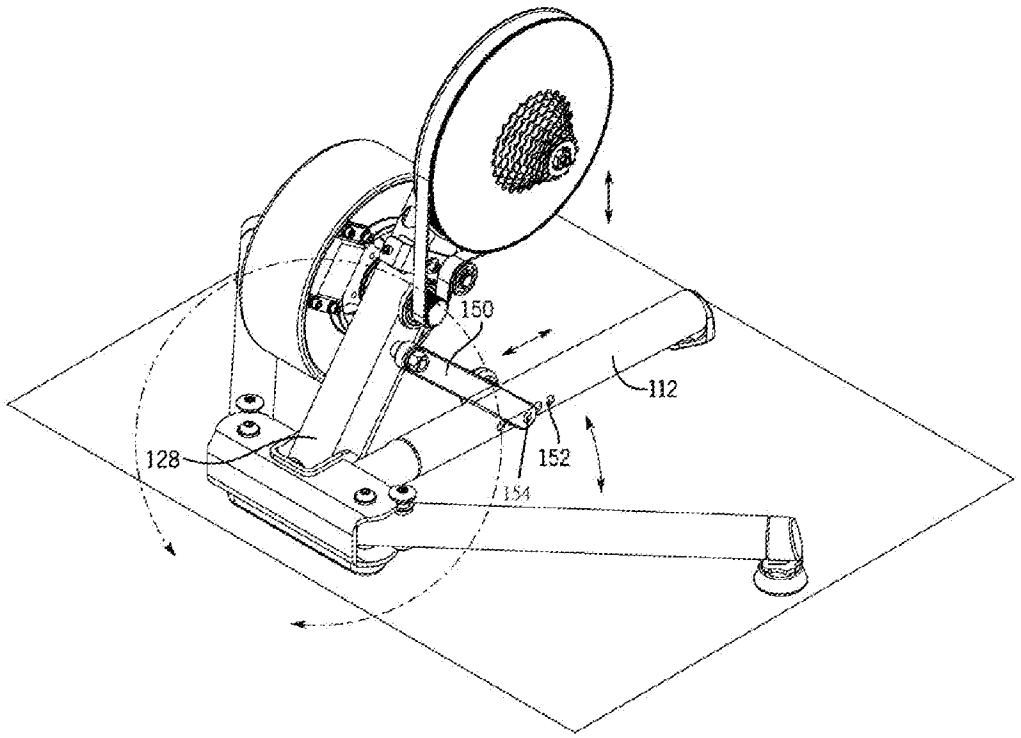
FIG. 1 (Prior Art)
FIG. 1 depicts a conventional bicycle trainer with a height adjustment bracket.
Figure 2:
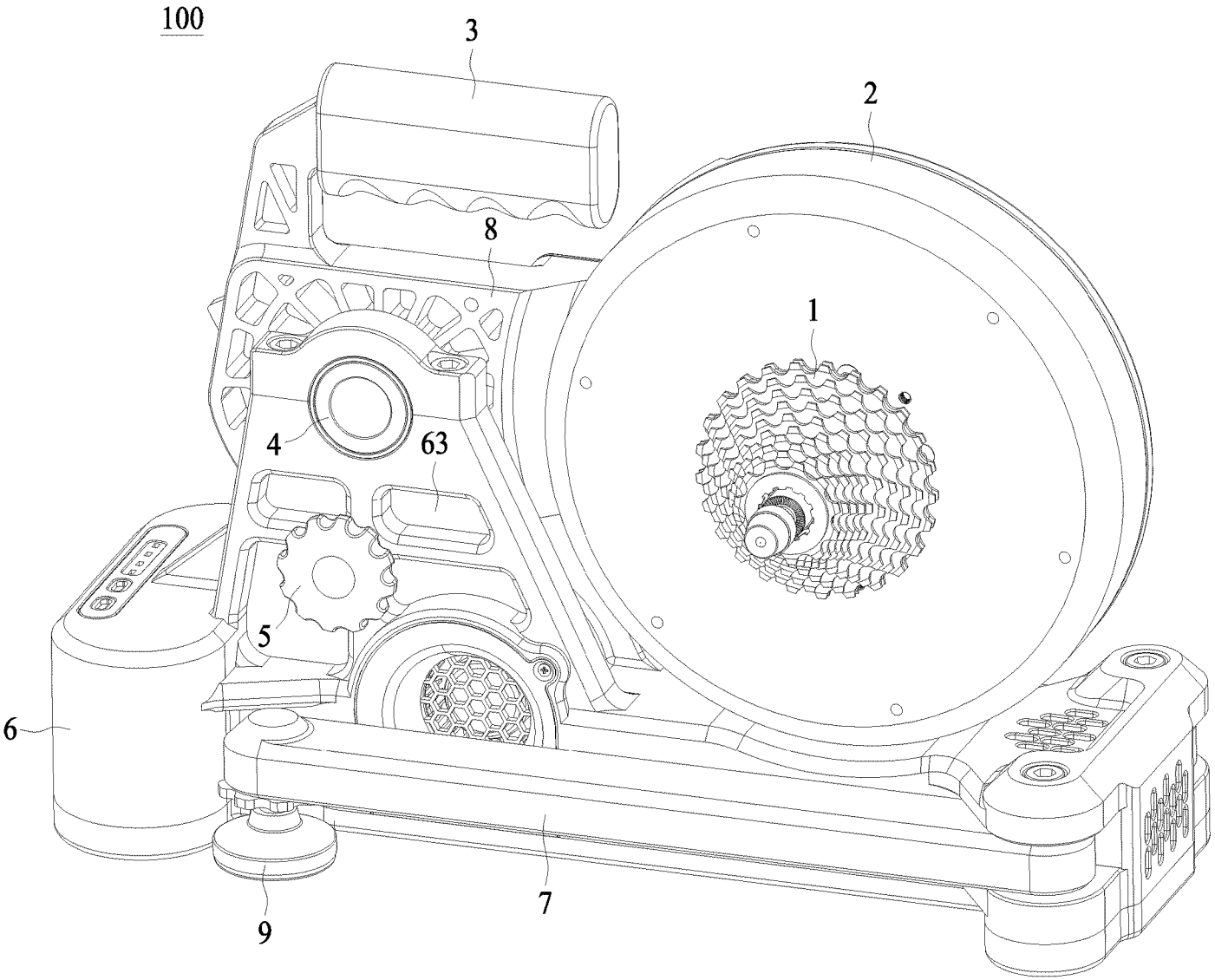
FIG. 2 depicts a perspective front view of a bicycle trainer in a folded mode in accordance with a first embodiment of the present invention.
Figure 3:
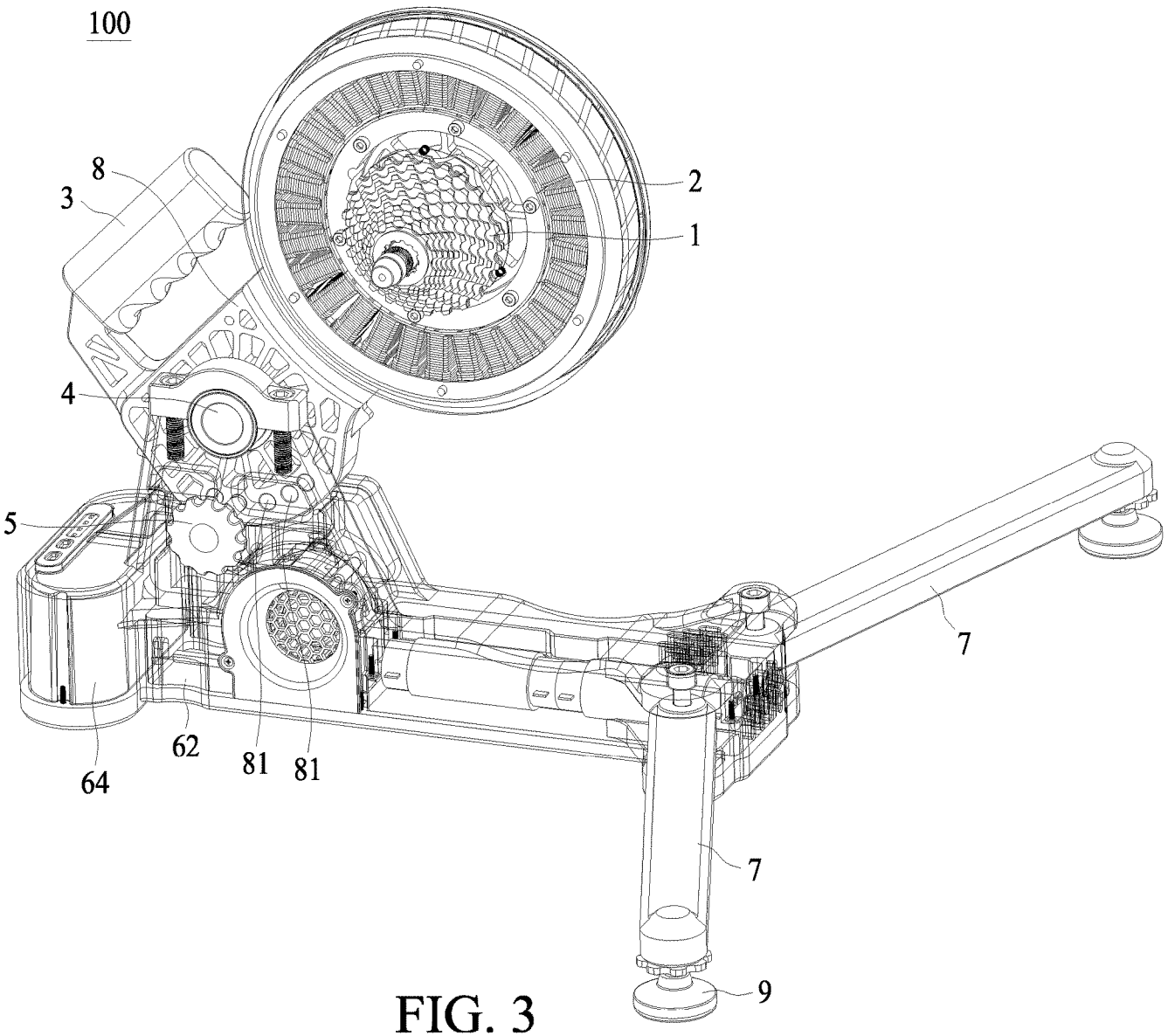
FIG. 3 depicts a perspective front view of the bicycle trainer in a stretched out mode in accordance with the first embodiment of the present invention.
Figure 4:
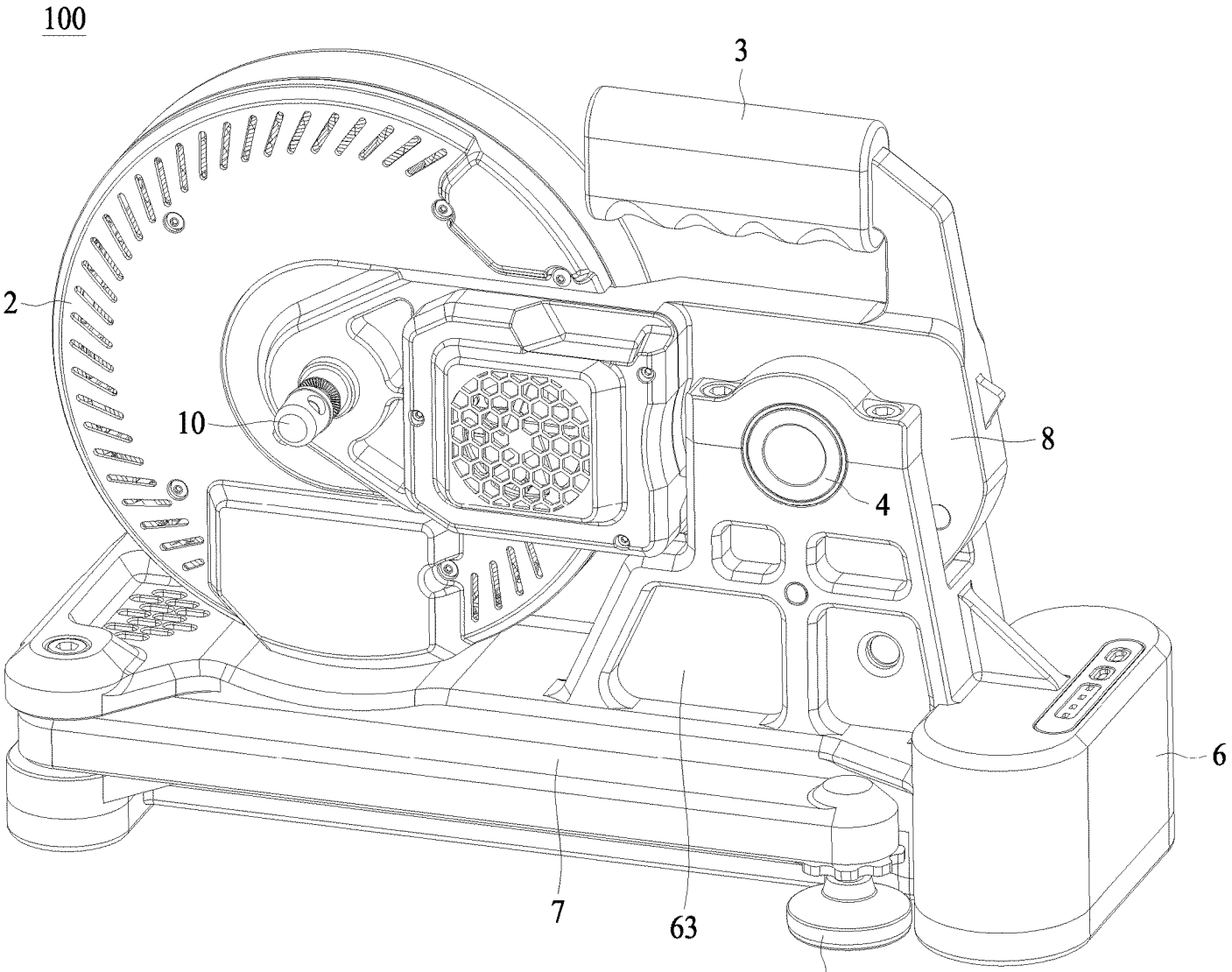
FIG. 4 depicts a perspective back view of the bicycle trainer in the folded mode in accordance with the first embodiment of the present invention.
Figure 5:
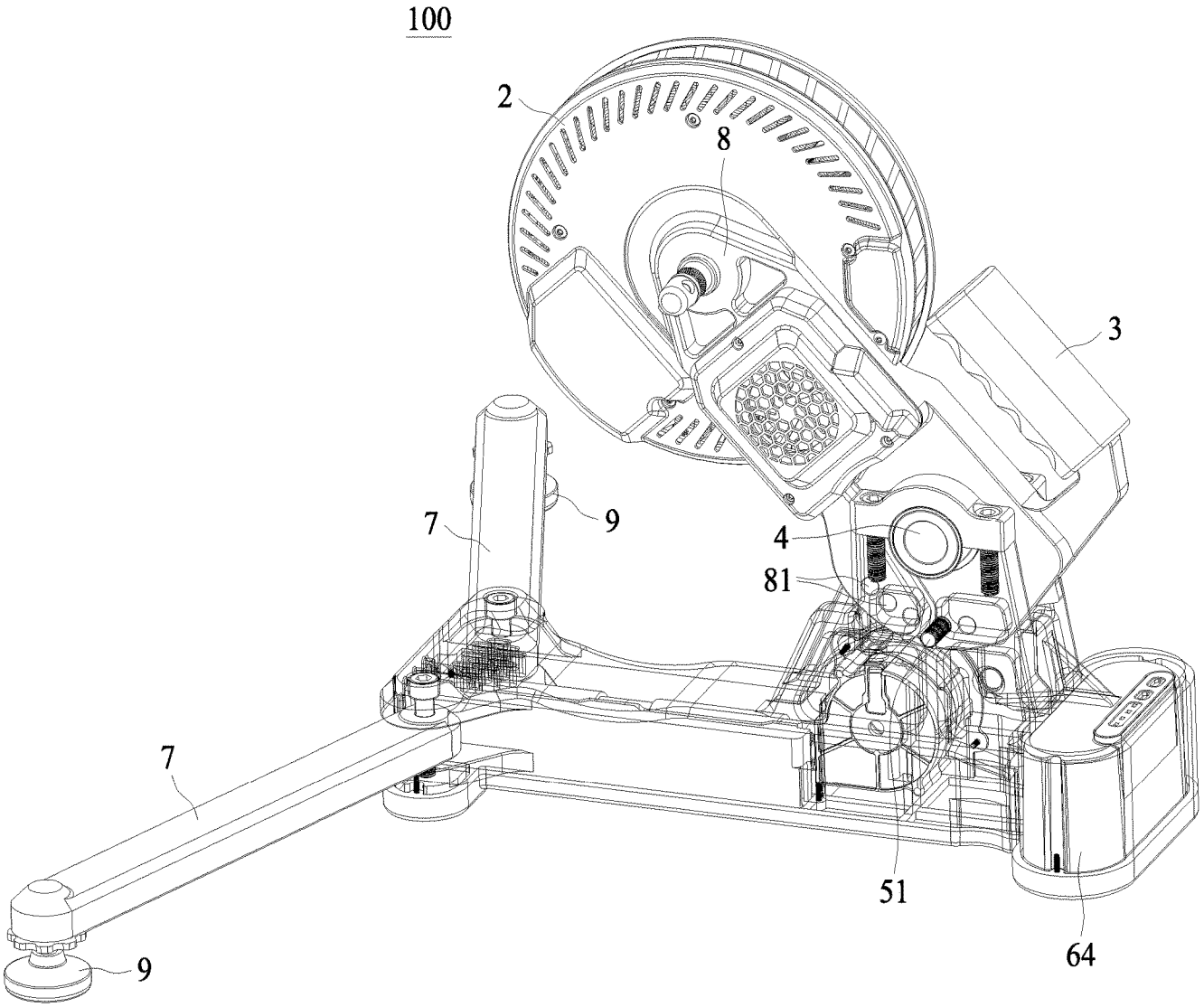
FIG. 5 depicts a perspective back view of the bicycle trainer in the stretched out mode in accordance with the first embodiment of the present invention.
Figure 6:
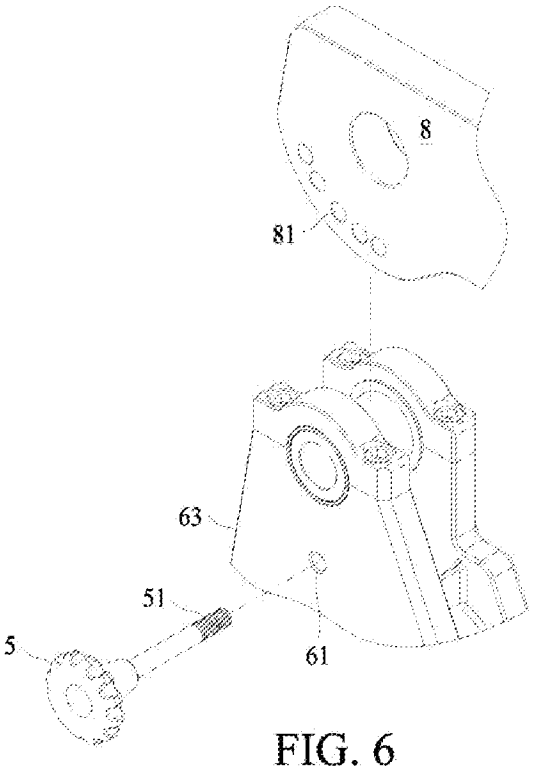
FIG. 6 depicts a view of a height adjusting member partially enlarged from FIGS. 2, 3, 4 and 5.
Figure 7:
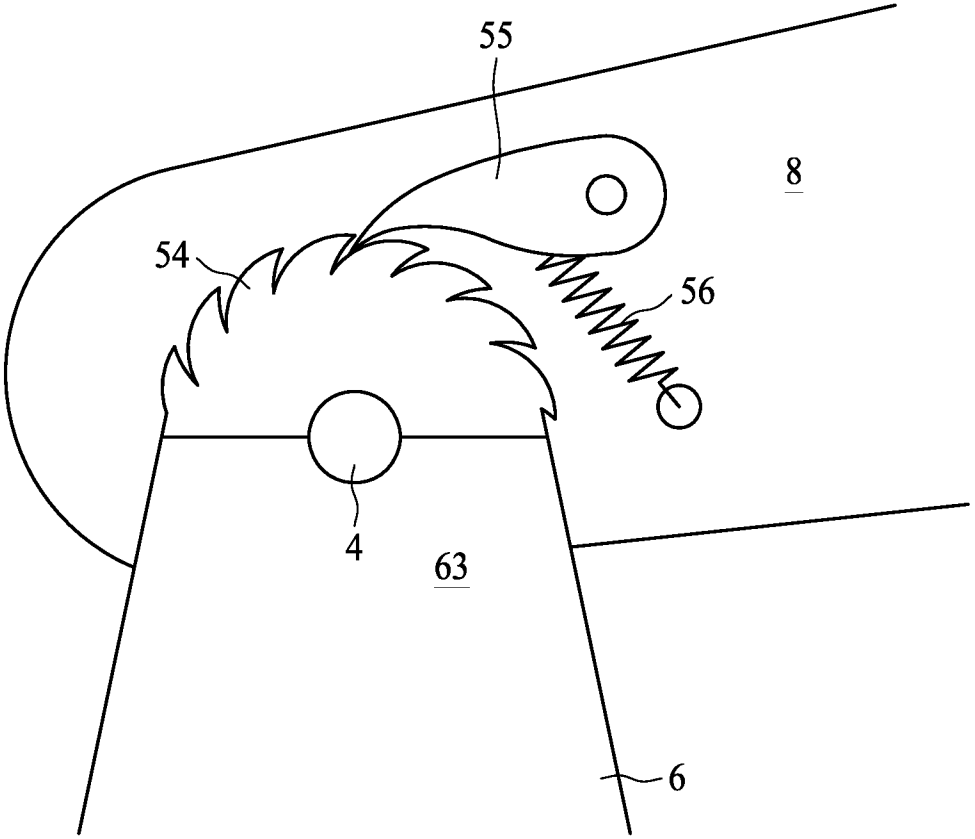
FIG. 7 depicts a view of another height adjusting member in accordance with the first embodiment of the present invention.
Figure 8:
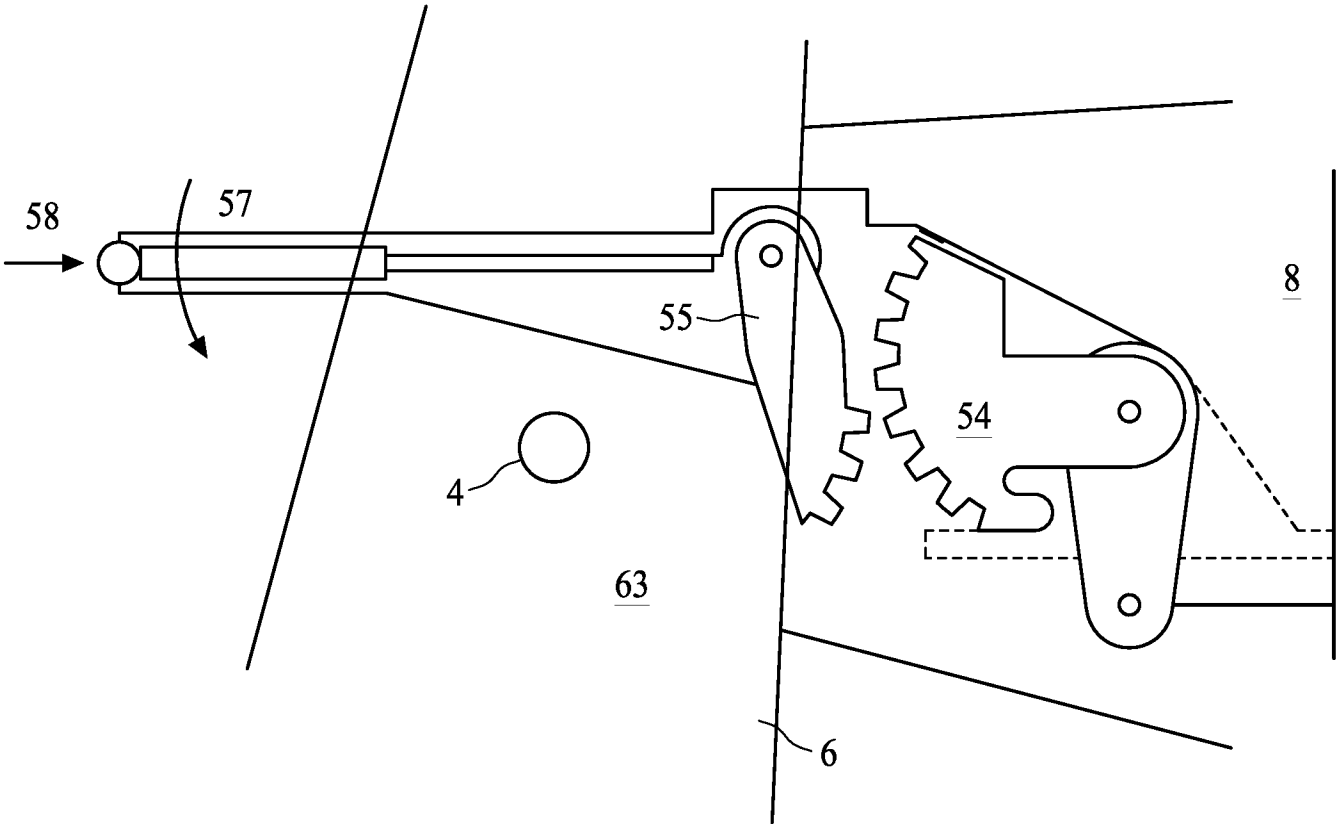
FIG. 8 depicts a view of yet another height adjusting member in accordance with the first embodiment of the present invention.

The first embodiment will be described with refer to FIGS. 2, 3, 4, 5, 6, 7 and 8. FIG. 2 depicts a perspective front view of the bicycle trainer (100) in the folded mode and FIG. 3 depicts that in the stretched out mode in accordance with the first embodiment of the present invention. FIG. 4 depicts a perspective back view of the bicycle trainer (100) in the folded mode and FIG. 5 depicts that in the stretched out mode in accordance with the first embodiment of the present invention. FIG. 6 depicts a view of a height adjusting member partially enlarged from FIGS. 2, 3, 4 and 5. FIG. 7 depicts a view of another height adjusting member in accordance with the first embodiment of the present invention. FIG. 8 depicts a view of yet another height adjusting member in accordance with the first embodiment of the present invention.

Firstly, refer to FIGS. 2, 3, 4 and 5. The bicycle trainer (100) comprises a cassette module (1), a flywheel module (2) including a motor and/or a generator, a handle (3), an axle (4), a locating pin (51) with a knob (5), a base (6), two legs (7), a supporting frame (8) and foots (9). The base (6) includes a base portion (62) and a standing portion (63). The legs (7) are pivotally mounted on the base (6), and the foots (9) are respectively disposed at one end of the legs (7) to increase the friction with the ground. The cassette module (1) having multiple sprockets that provides multiple gear ratios to the user. The cassette module (1) and the flywheel module (2) are mounted on the supporting frame (8) and are coaxial around an axle (10) including a set of elements for supporting the cassette module (1), the flywheel module (2), bearings and a hub (not shown). The supporting frame (8) is rotationally pivoted on the standing portion (63) of the base (6) around the axle (4). Furthermore, an electrical power source accommodated in the base (6), such as battery cells (64) or battery packs (64), is used to power up electrical components or devices in the bicycle trainer (100), such as an LCD display, a controlling system that drive the motor with pre-programmed courses or a wireless device. The electrical power source can further be used as a power source providing electricity to the user's electronic devices, such as a smart phone, a cellular phone or a speaker. The battery cells (64) or battery packs (64) may be charged by the flywheel module (2) as a power generator during cycling exercise.

There are several holes located near the edge of the supporting frame (8) for receiving the locating pin (51) with the knob (5). When the bicycle trainer (100) is in the folded mode, the locating pin (51) with the knob (5) is fixed at one of the holes of the supporting frame (8) to keep the supporting frame (8) at low profile. The bicycle trainer (100) becomes compact and easy to carry by hand with the handle (3) which is disposed at or near the top of the bicycle trainer (100).

When the user wants to exercise, the user may easily fold out the legs (7) at a desired angle, such as 45, 60, 90 or 135 degrees or any desired degrees with respect to the base (6). The user may also easily grab the knob (5) and release the locating pin (51) from the supporting frame (8) and the standing portion (63) of the base (6). Then, the user may easily apply a lifting force to the supporting frame (8) with the handle (3) which causes the supporting frame (8) to rotate around the axle (4) at a desired angle. Then, the user may easily insert the locating pin (51) into supporting frame (8) and the standing portion (63) of the base (6) so as to keep the supporting frame (8) at a desired height. The bicycle trainer (100) is in the stretched out mode after folding out the legs (7) and the supporting frame (8). Then, the user may mount his/her own bicycle with the rear wheel been removed to the bicycle trainer (100) through the cassette module (1).

Now refer to FIG. 6 as well. It further depicts a height adjusting member of the bicycle trainer (100) which allows the user to use the handle (3) to lift up the supporting frame (8) by means of rotation of the supporting frame (8) around the axle (4). The height adjusting member can be used to adjust the angle between the supporting frame (8) and the standing portion (63) of the base (6) so that the height of the axle (10) is varied accordingly.

The height adjusting member depicted in FIG. 6 comprises the supporting frame (8), the standing portion (63) of the base (6), the locating pin (51) with the knob (5) and a locking unit (optional and not shown). The supporting frame (8) has a plurality of locating holes (81) located near the edge of the supporting frame (8). The standing portion (63) of the base (6) has two aligning holes (61) located on both sides of the standing portion (63). The locating pin (51) extending from the knob (5), such as a star knob, wing knob or ball knob with threaded stud, may clamp the standing portion (63) with a female locking unit, such as a star nut, wing nut or ball nut. That is, the locating pin (51) may in turn pass through the aligning hole (61) at one side of the standing portion (63), one of the locating holes (81) and the aligning hole (61) at other side of the standing portion (63) and then be fastened by the female locking unit so as to support the supporting frame (8) at a predetermined height, i.e. to keep the supporting frame (8) at a predetermined angle with respect to the standing portion (63). Alternatively, the locating pin (51) may in turn pass through the aligning hole (61) at one side of the standing portion (63) and one of the locating holes (81) and then be fastened to the aligning hole (61) at other side of the standing portion (63). In this case, the aligning hole (61) at other side of the standing portion (63) are formed with female screws. In another embodiment, a plurality of aligning holes (61) are respectively arranged on both sides of the standing portion (63), and a locating hole (81) is disposed on the supporting frame (8).

The locating holes (81) are formed near the edge of the supporting frame (8) and substantially arranged along an arc or a circle centered at the axle (4). When the locating pin (51) optionally goes through a different one of the locating holes (81), the upright or swinging angle of the supporting frame (8) is consequentially changed. That is, the height of the assembly of the cassette module (1), the flywheel module (2) and the supporting frame (8) is varied due to the angle adjustment.

One should note that, in order to improve the mechanical strength, there might be more aligning holes (61) on the standing portion (63) for other locating pins (51) to pass through.

Now refer to FIGS. 7 and 8 as well. They further depict two variations of the height adjusting member to the bicycle trainer (100) which also allow the user to use the handle (3)

to lift up the supporting frame (8) by means of rotation of the supporting frame (8) around the axle (4).

The height adjusting member depicted in FIG. 7 comprises the supporting frame (8), the standing portion (63) of the base (6), a ratchet part (54), a pawl (55) and a spring (56). The pawl (55) can engage with a teeth of the ratchet part (54) to keep the supporting frame (8) at a predetermined angle with respect to the standing portion (63). The pawl (55) is optionally engaged with a different teeth or edge of the ratchet part (54) so that the upright or swinging angle of the supporting frame (8) is consequentially changed.

Compared with FIG. 7, the height adjusting member depicted in FIG. 8 comprises the supporting frame (8), the standing portion (63) of the base (6), a ratchet part (54), a pawl (55), a clutch (57) and a button (58). The ratchet part (54) is fixed or formed on the supporting frame (8) and the pawl (55) is pivoted on the standing portion (63). There is a clutch (57) used to easily release the engaged pawl (55) by pushing the button (58) from the ratchet part (54) against the force exerted on the pawl (55) so that the upright or swinging angle of the supporting frame (8) is consequentially changed.

In addition to the above designs, any fixing parts or engaging parts can be used to adjust the angle between the supporting frame (8) and the standing portion (63) can be applied to the bicycle trainer (100) and thus are within the scope of this embodiment. Back to FIGS. 2, 3, 4 and 5, the flywheel module (2) may include a dual mode motor which can simulate uphill and downhill cycling circumstance. With the height adjusting member depicted in FIG. 6, 7 or 8, the user may easily adjust the height of the bicycle trainer (100) to further correspondingly creates a tilted circumstance just like cycling uphill and downhill.

The Second Embodiment

Figure 9:
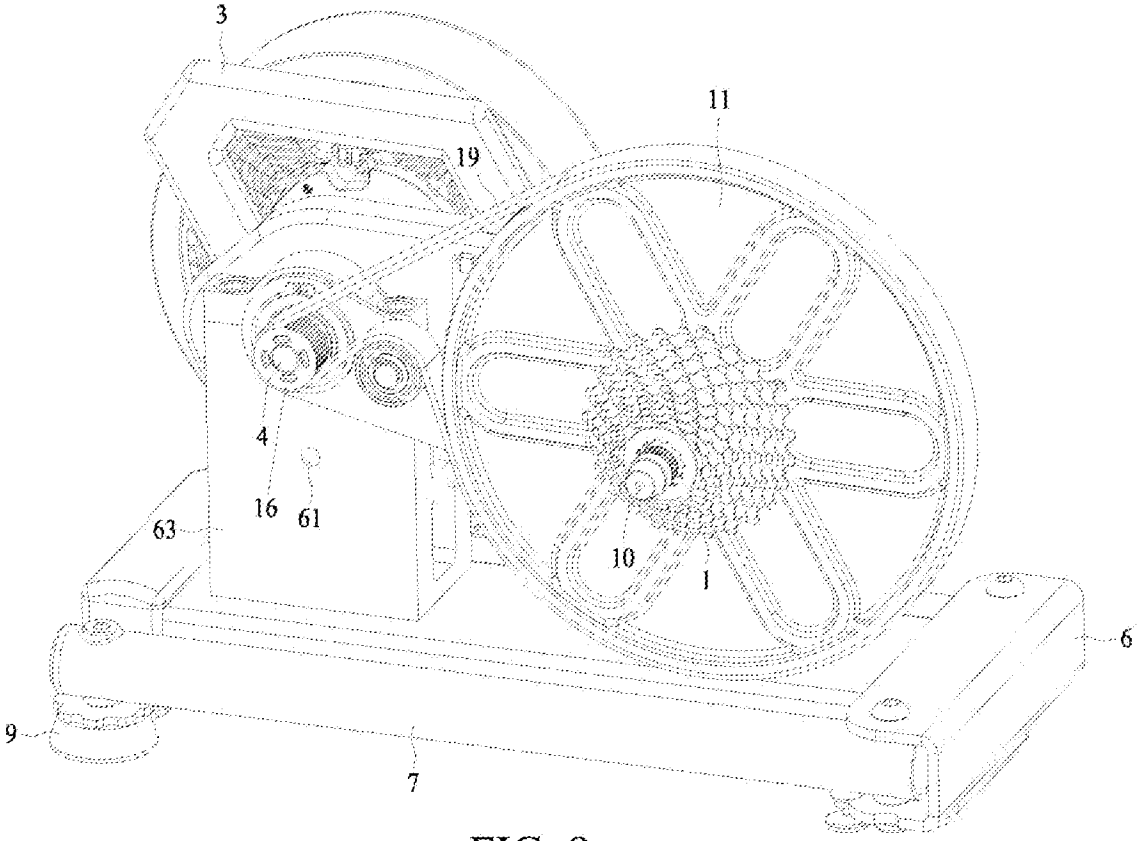
FIG. 9 depicts a perspective front view of a bicycle trainer in a folded mode in accordance with a second embodiment of the present invention.
Figure 10:
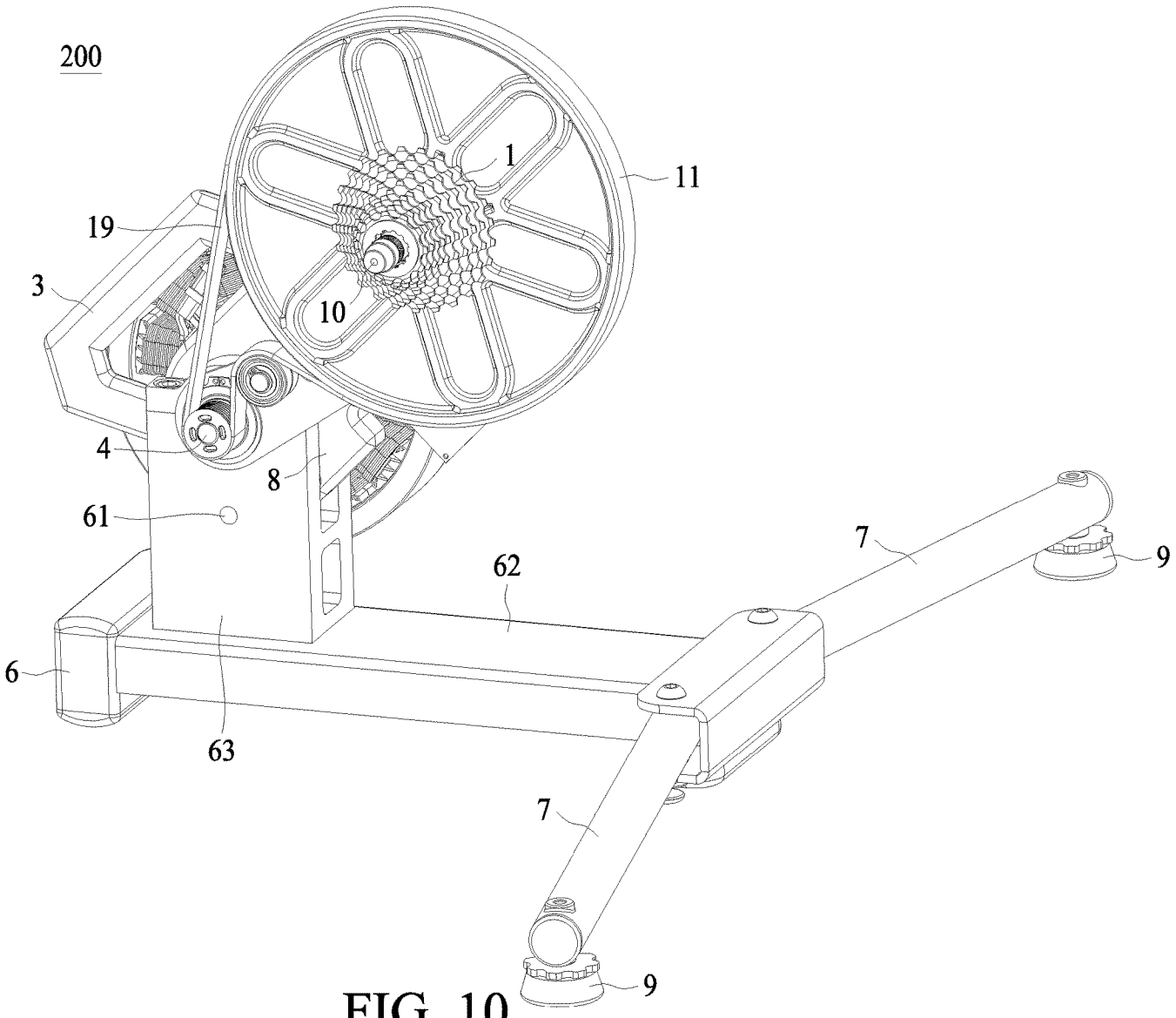
FIG. 10 depicts a perspective front view of the bicycle trainer in a stretched out mode in accordance with the second embodiment of the present invention.
Figure 11:
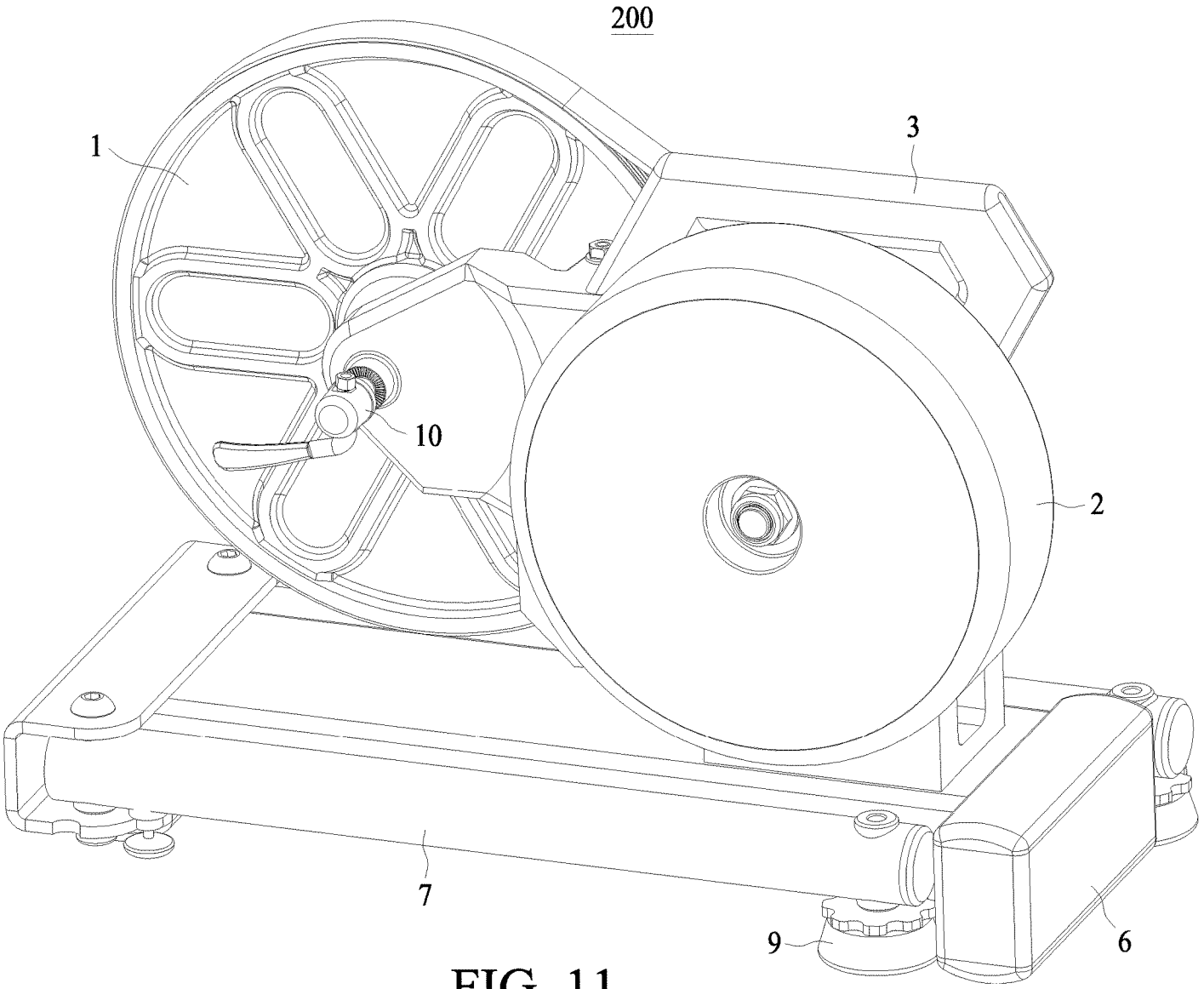
FIG. 11 depicts a perspective back view of the bicycle trainer in the folded mode in accordance with the second embodiment of the present invention.
Figure 12:
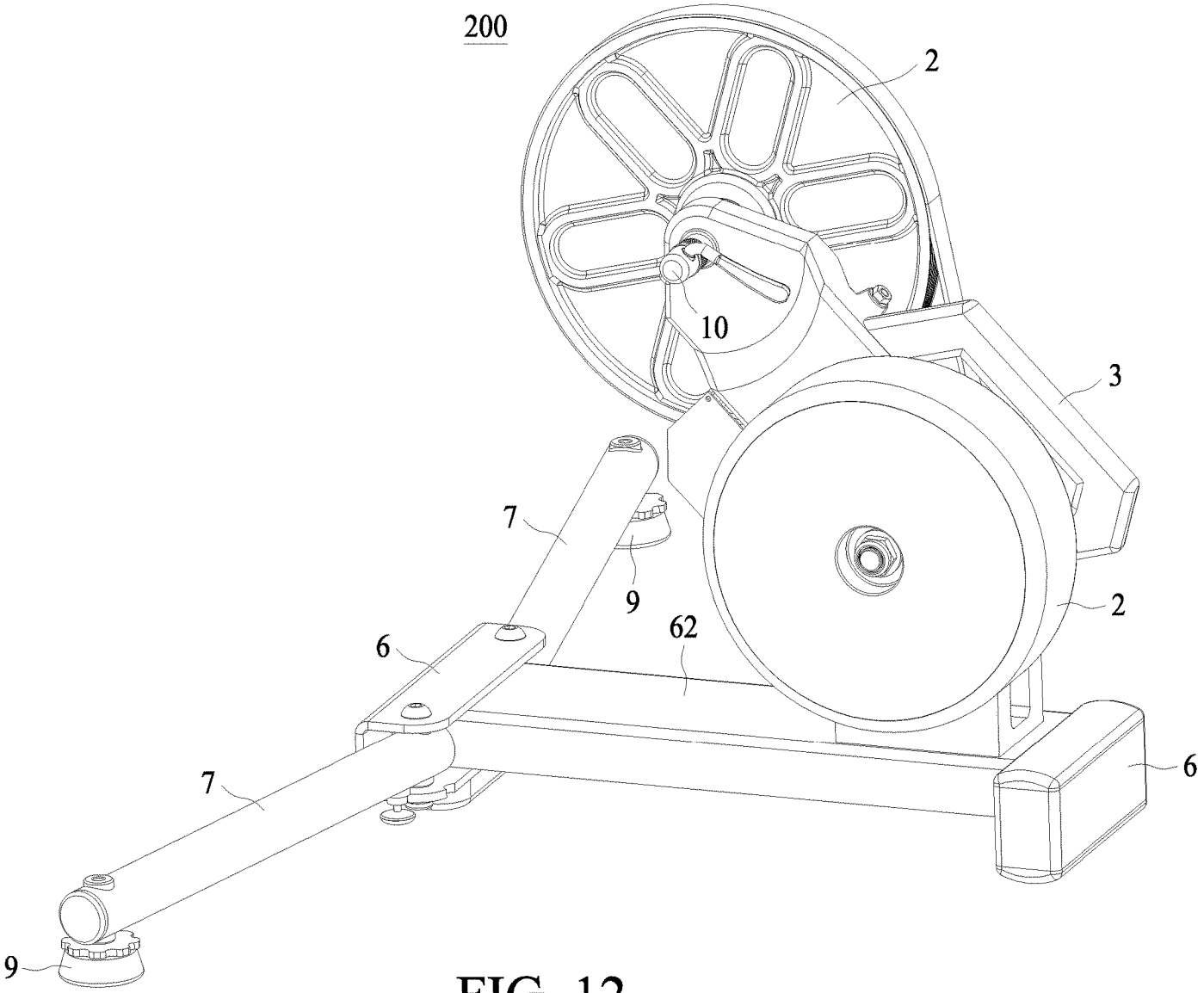
FIG. 12 depicts a perspective back view of the bicycle trainer in the stretched out mode in accordance with the second embodiment of the present invention.

The second embodiment will be described with refer to FIGS. 9, 10, 11, 12 and 13. FIG. 9 depicts a perspective front view of the bicycle trainer (200) in the folded mode and FIG. 10 depicts that in the stretched out mode in accordance with the second embodiment of the present invention. FIG. 11 depicts a perspective back view of the bicycle trainer (200) in the folded mode and FIG. 12 depicts that in the stretched out mode in accordance with the second embodiment of the present invention. The element of the second embodiment which is the same or similar with that of the first embodiment will be given the same or similar symbol.

The bicycle trainer (200) comprises a cassette module (1), a flywheel module (2), a handle (3), an axle (4), a knob (5) with a locating pin (not shown), a base (6), legs (7), a supporting frame (8) and foots (9). The base (6) includes a base portion (62) and a standing portion (63). The legs (7) are pivotally mounted on the base (6) and the foots (9) are respectively disposed at one end of the legs (7) to increase the friction with the ground. The cassette module (1) having multiple sprockets that provides multiple gear ratios to the user. The cassette module (1) and the flywheel module (2) are mounted on the supporting frame (8), but they respectively rotate around different axles (4, 10). The supporting frame (8) is rotationally pivoted around the axle (4) which is same as the first embodiment.

Similar to the foregoing first embodiment, the height adjusting member depicted in FIGS. 6, 7 and 8 can be applied to the second embodiment so as to adjust the angle between the supporting frame (8) and the standing portion (63) of the base (6) to correspondingly vary the height of the axle (10).

When the bicycle trainer (200) is in the folded mode, the legs (7) and the supporting frame (8) are kept at low profile. The bicycle trainer (200) becomes compact and easy to carry by hand with the handle (3) which is disposed at or near the top of the bicycle trainer (200).

When the user wants to exercise, the user may easily fold out the legs (7) at a desired angle, such as 45, 60, 90 or 100 degrees or any desired degrees with respect to the base (6). Restricted by the structure of the base (6) of the second embodiment, each leg (7) can be spread at slightly larger than 90 degrees. The bicycle trainer (200) is in the stretched out mode after folding out the legs (7) and lifting the supporting frame (8) by the height adjustment member as depicted in FIGS. 6, 7 and 8. Then, the user may mount his/her own bicycle with the rear wheel been removed to the bicycle trainer (200) through the cassette module (1).

Figure 13:
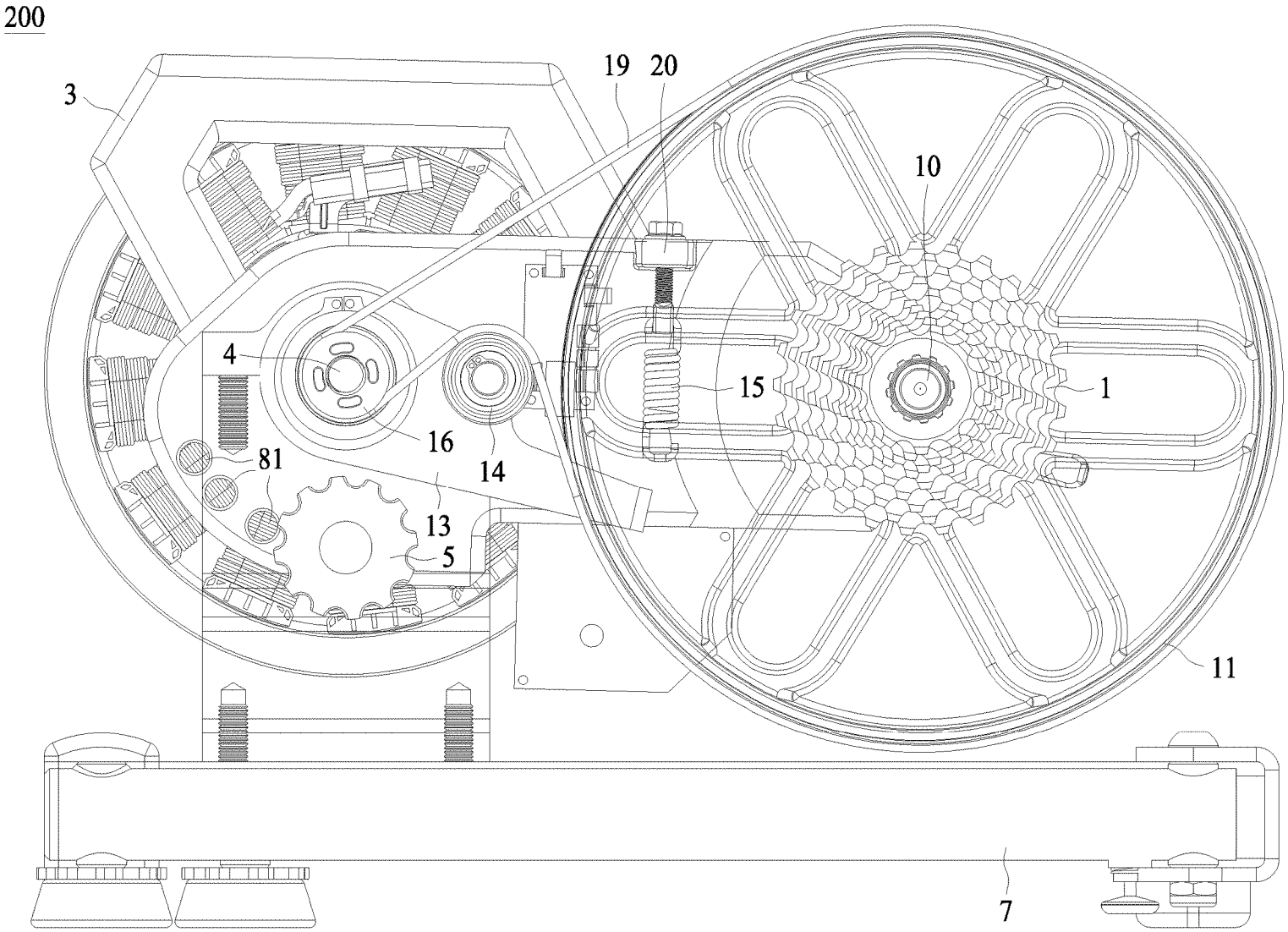
FIG. 13 depicts a front view of the bicycle trainer in the folded mode in accordance with the second embodiment of the present invention.

Now refer to FIG. 13, which is a front view of the bicycle trainer (200) in the folded mode in accordance with the second embodiment of the present invention. As shown in FIG. 13, the bicycle trainer (200) further comprises a tension adjustment mechanism includes a belt tension arm (13) pivoted around the axle (4), an idler pulley (14) pivoted on the belt tension arm (13) and a spring (15). One end of the spring (15) is connected to one end of the belt tension arm (13) and the other end of the spring (15) is connected to the housing of the supporting frame (8). The belt tension arm (13) can be clockwise or anticlockwise pulled (or pushed in a different design) by the spring (15) so that the idler pulley (14) exerts force on the belt (19). That is, the tension of the belt (19) is increased or decreased in response to the change of the height adjustment of the axle (10) and the angle formed by the supporting frame (8) and the standing portion (63) so as to maintain a proper tension force of the belt (19) automatically. Besides, it also allows the user to manually adjust the degree of the stretch of the spring (15) through a nut (20). The belt (19) is around a cassette pulley (11), the idler pulley (14) and a flywheel pulley (16). The two ends of the spring (15) are respectively fixed to the belt tension arm (13) and the supporting frame (8) through a kit set including a hook, a bolt and a nut or other adjustable kits. To be concluded, the flywheel pulley (16), the belt tension arm (13), the supporting frame (8) and the flywheel module (2) are rotationally co-pivoted around the axle (4).

The flywheel module (2) may include a magnetic resistance component which can provide brake force to the user to simulate uphill riding circumstance. The magnetic resistance component makes use of electromagnet to provide the user with variable resistance. With control of the level of electric current flowing through the magnets, such as 2 poles, 4 poles, 6 poles, 12 poles magnets comprising an iron core and a wire wound into a coil, variable resistance is provided. More current flowing through the magnets means a stronger magnetic force, which increases the resistance in the flywheel module (2).

With the height adjusting member depicted in FIG. 6, 7 or 8, the user may easily adjust the height of the bicycle trainer (200) to further correspondingly creates a tilted circumstance just like cycling uphill.

In addition, the bicycle trainer (200) may also accommodate an electrical power source, such as battery cells or battery packs in the base (6). The electrical power source can use to power up electrical components or devices in the bicycle trainer (200), such as an LCD display, a controlling system that drive the motor with pre-programmed courses or a wireless device. The electrical power source can further be used as a power source providing electricity to the user's electronic devices, such as a smart phone, a cellular phone or a speaker. The battery cells or battery packs may also be charged by the flywheel module (2) operated in a generating mode during cycling exercise.

The Third Embodiment

Figure 14:
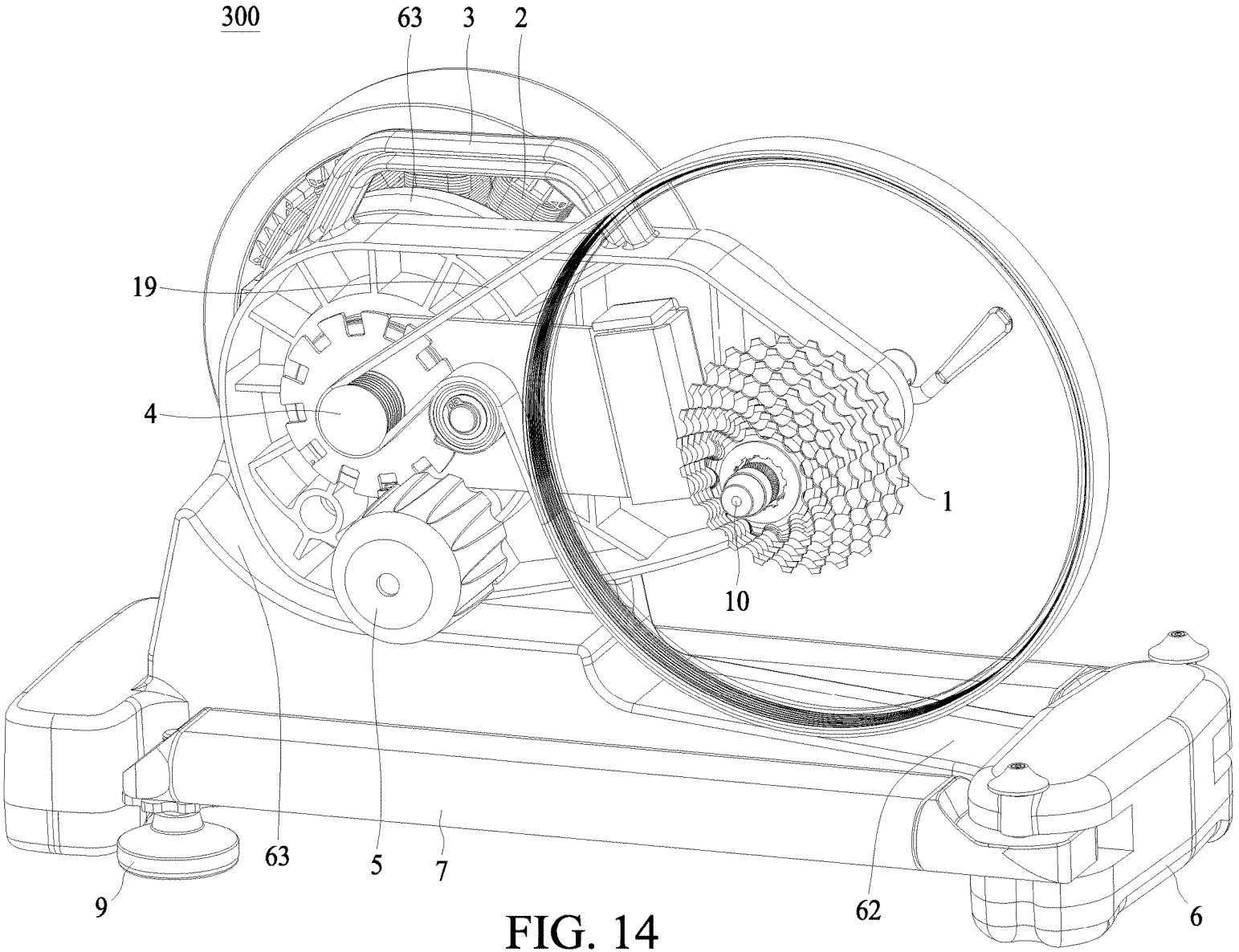
FIG. 14 depicts a perspective front view of a bicycle trainer in a folded mode in accordance with a third embodiment of the present invention.
Figure 15:
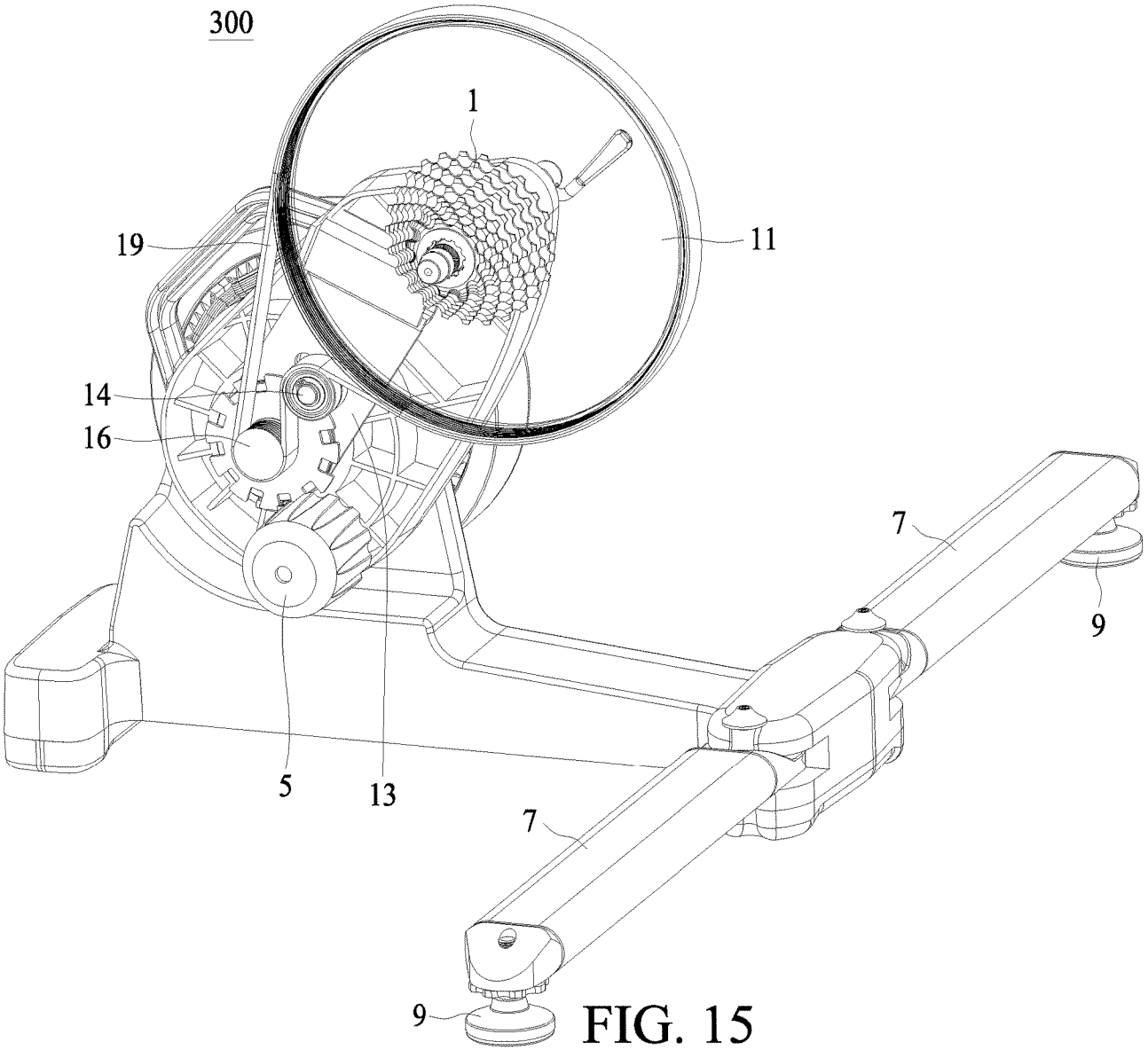
FIG. 15 depicts a perspective front view of the bicycle trainer in a stretched out mode in accordance with the third embodiment of the present invention.
Figure 16:
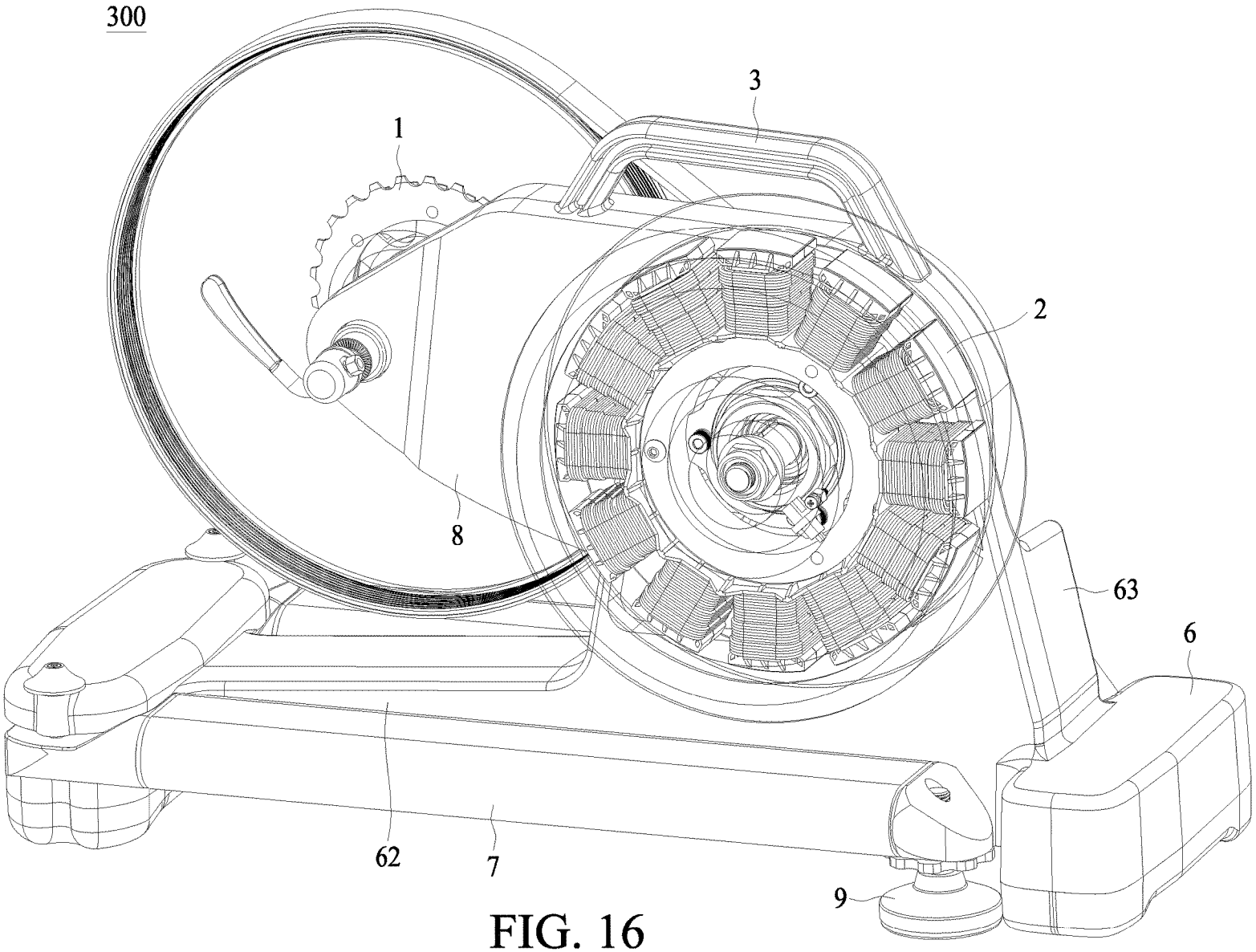
FIG. 16 depicts a perspective back view of the bicycle trainer in the folded mode in accordance with the third embodiment of the present invention.
Figure 17:
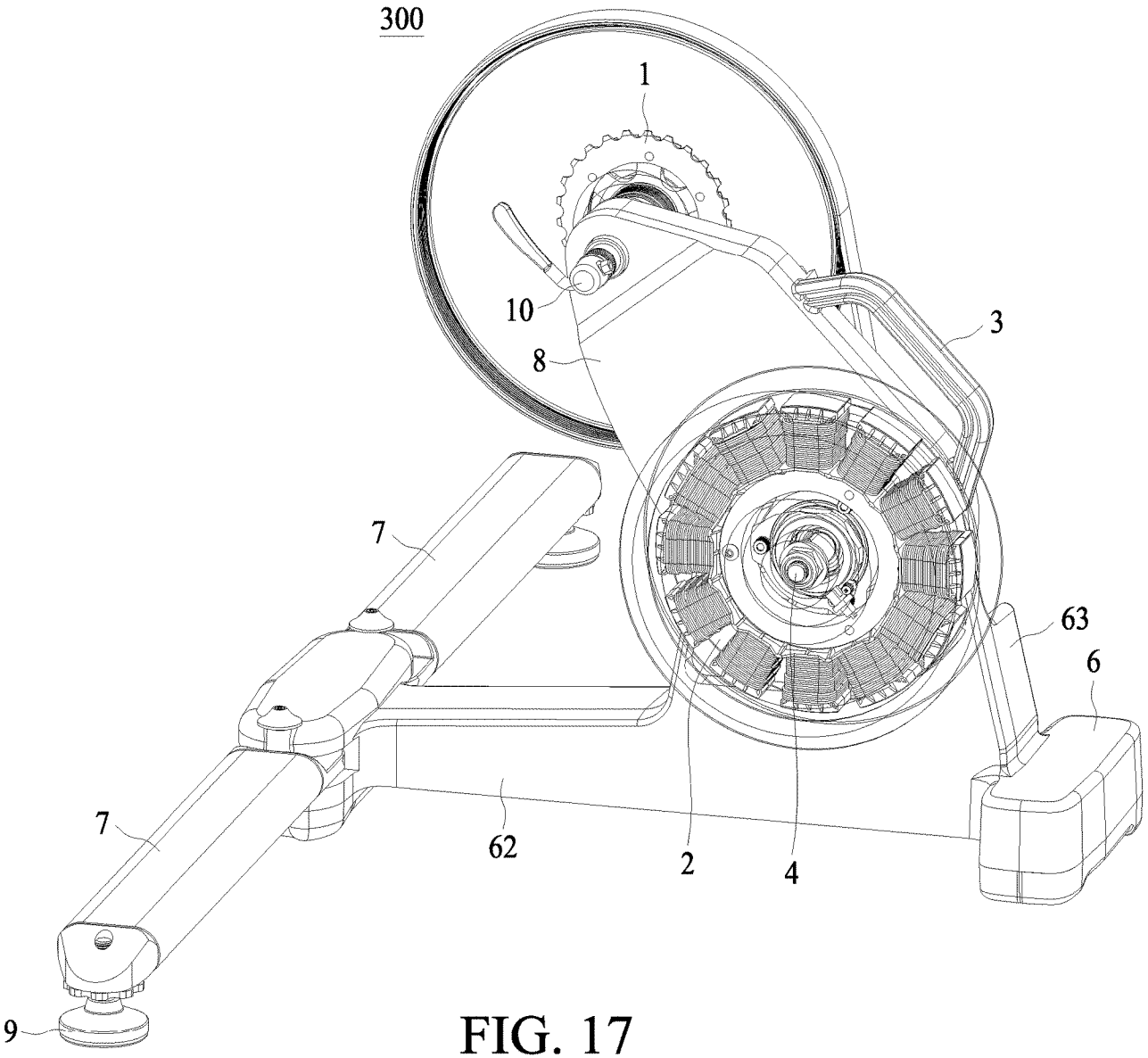
FIG. 17 depicts a perspective back view of the bicycle trainer in the stretched out mode in accordance with the third embodiment of the present invention.

The third embodiment will be described with refer to FIGS. 14, 15, 16 and 17. FIG. 14 depicts a perspective front view of the bicycle trainer (300) in the folded mode and FIG. 15 depicts that in the stretched out mode in accordance with the third embodiment of the present invention. FIG. 16 depicts a perspective back view of the bicycle trainer (300) in the folded mode and FIG. 17 depicts that in the stretched out mode in accordance with the third embodiment of the present invention. The element of the third embodiment which is the same or similar with that of the first or second embodiment will be given the same or similar symbol.

The bicycle trainer (300) comprises a cassette module (1), a flywheel module (2), a handle (3), an axle (4), a locating pin with a knob (5) (not shown), a base (6), legs (7), a supporting frame (8) and foots (9). The base (6) includes a base portion (62) and a standing portion (63). The structure of the third embodiment is similar with that of the second embodiment. One of the main differences between them is that the standing portion (63) of the base (6) of the third embodiment has only one single upright plate to hold the supporting frame (8) instead of two upright plates (or two sides) of the second embodiment as shown in FIGS. 9, 10, 11, 12 and 13. Accordingly, the same description made to the same element of embodiment 2 is omitted here for simplicity.

The Fourth Embodiment

Figure 18:
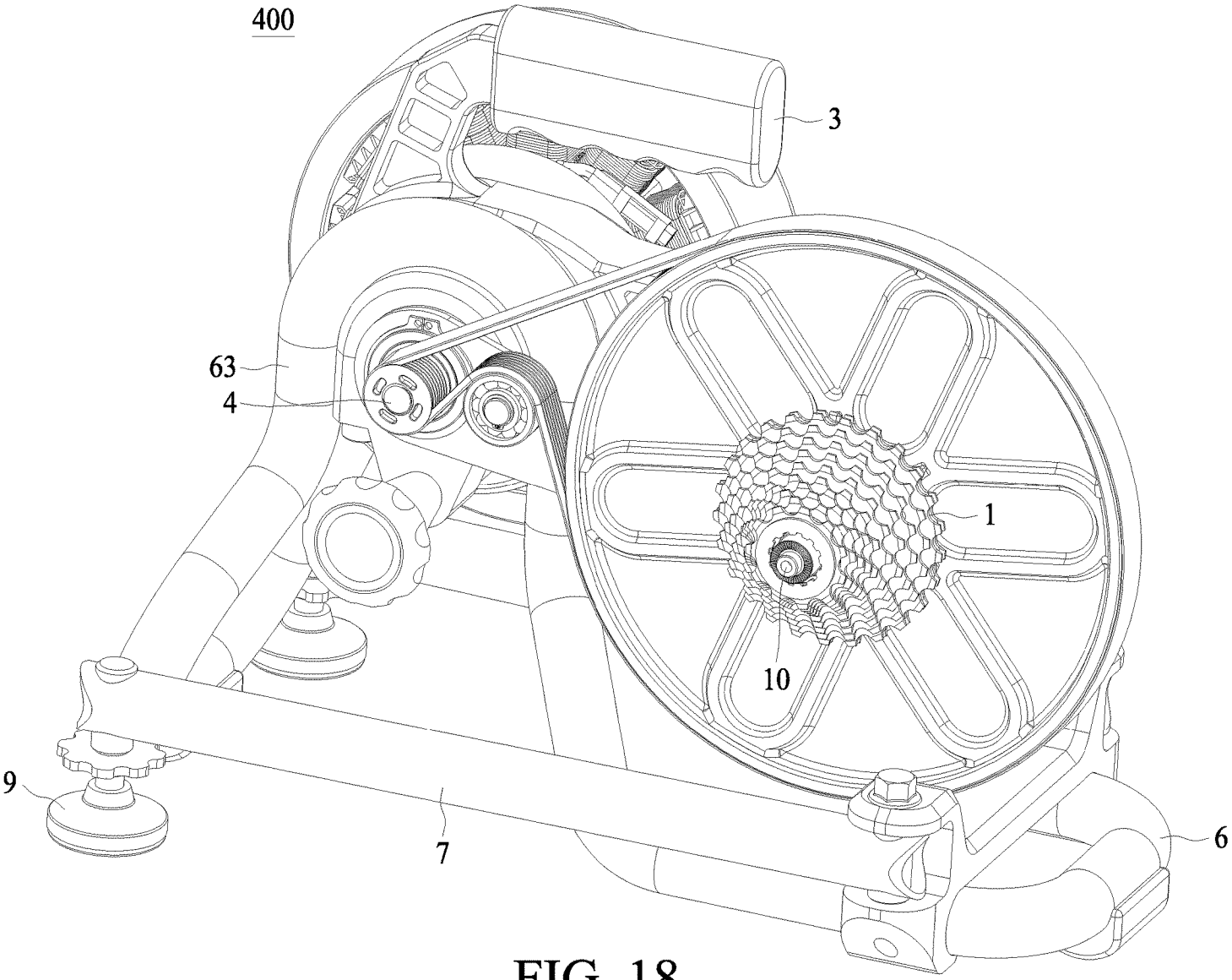
FIG. 18 depicts a perspective front view of a bicycle trainer in a folded mode in accordance with a fourth embodiment of the present invention.
Figure 19:
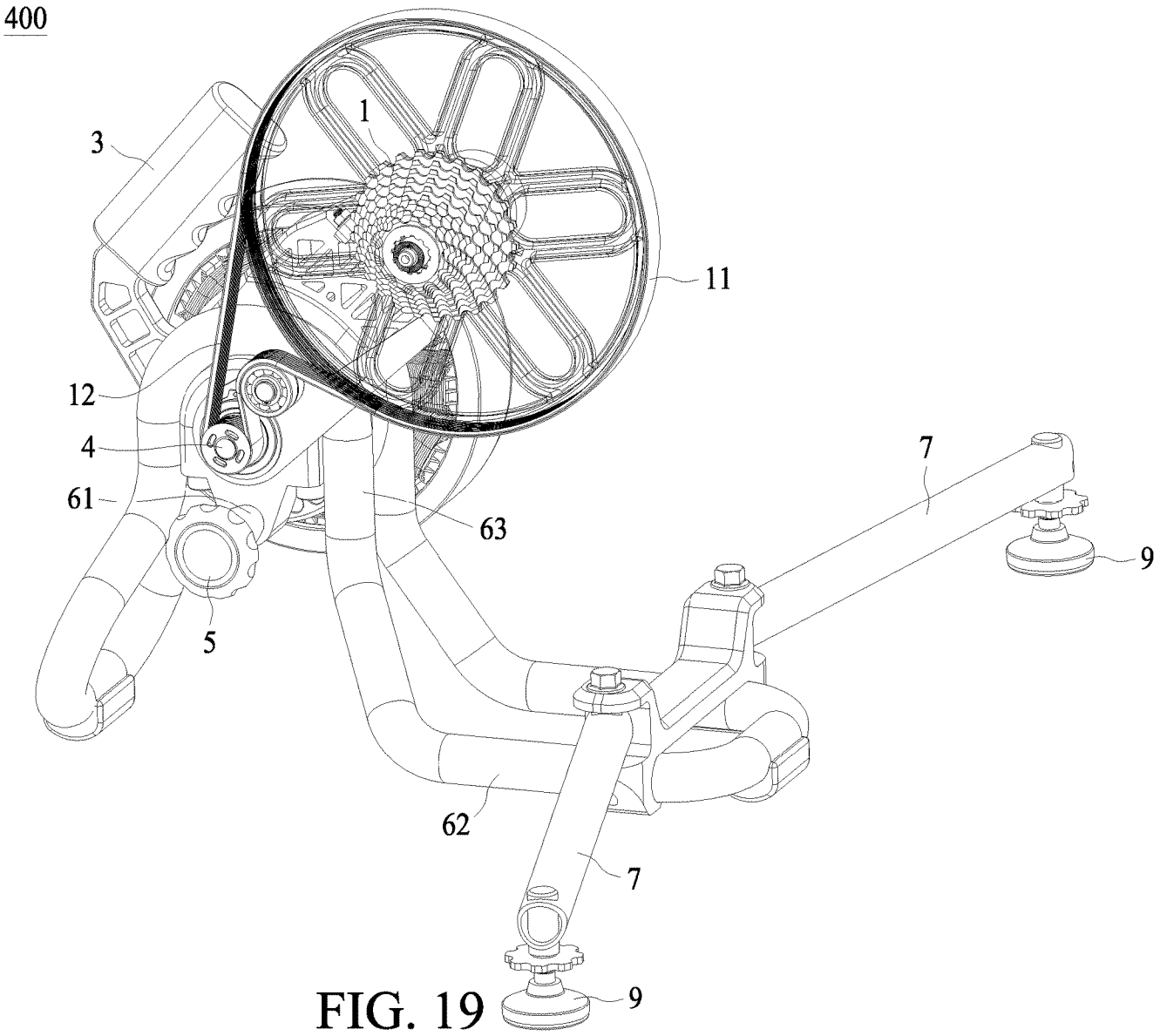
FIG. 19 depicts a perspective front view of the bicycle trainer in a stretched out mode in accordance with the fourth embodiment of the present invention.
Figure 20:
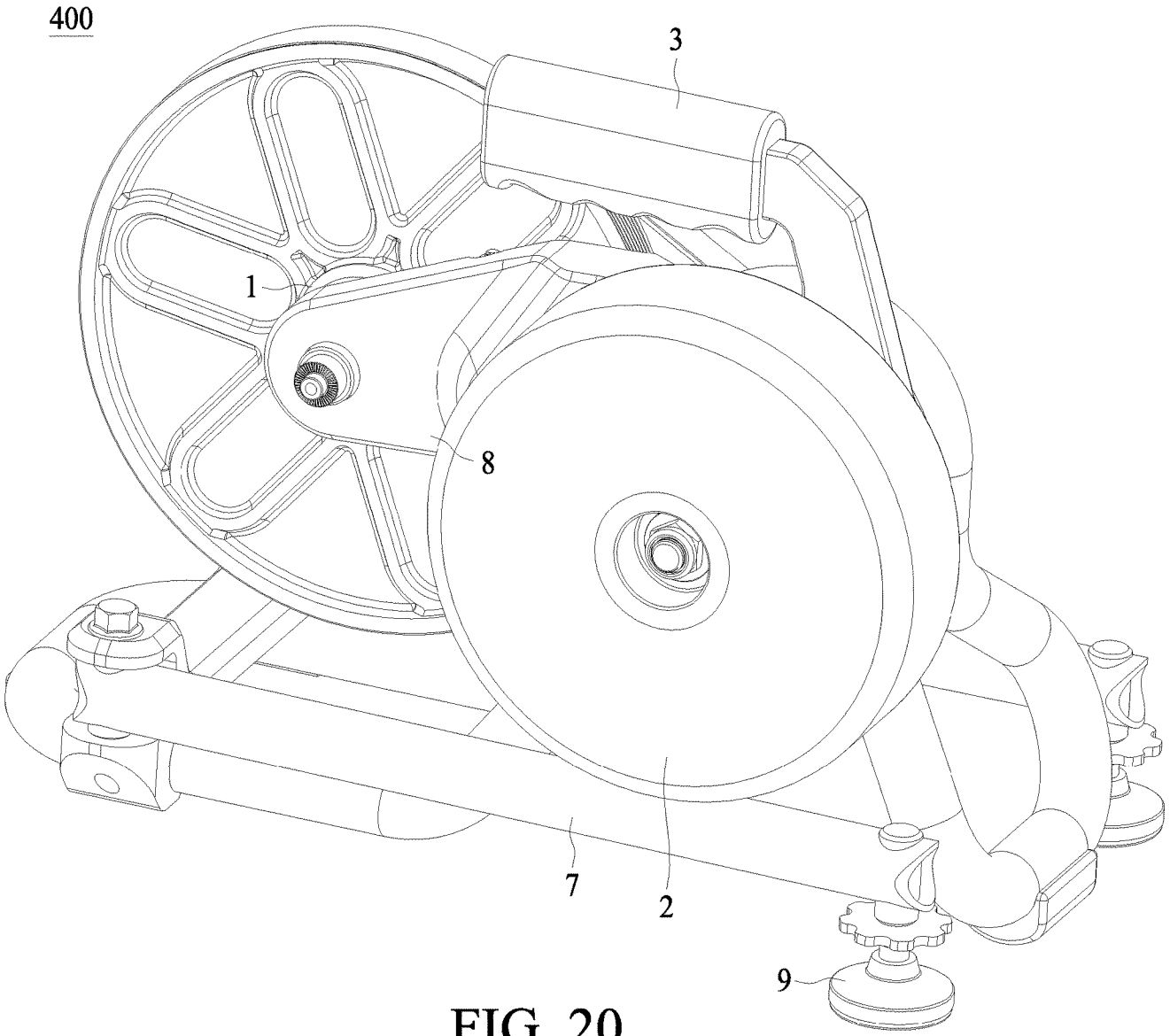
FIG. 20 depicts a perspective back view of the bicycle trainer in the folded mode in accordance with the fourth embodiment of the present invention.
Figure 21:
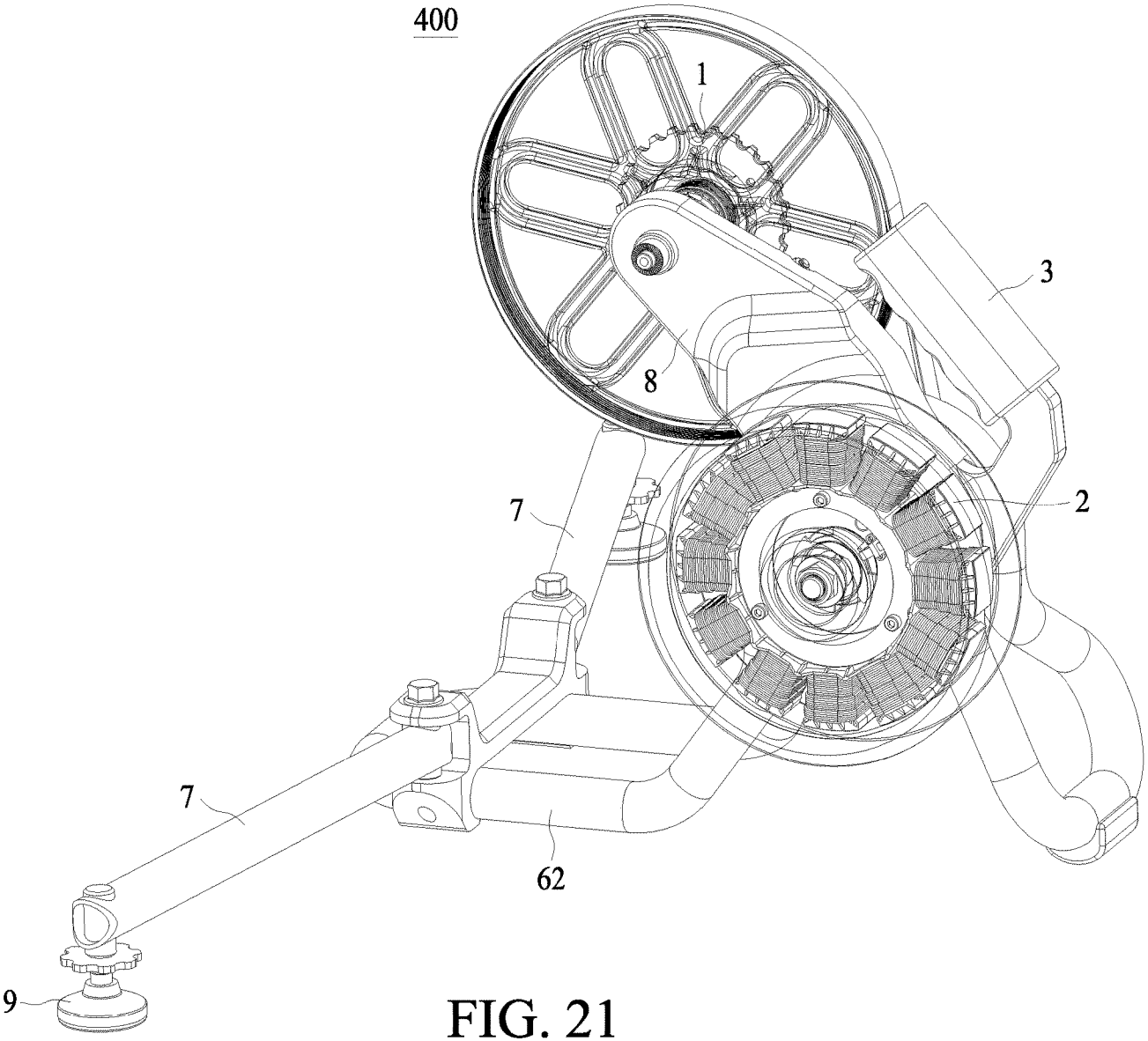
FIG. 21 depicts a perspective back view of the bicycle trainer in the stretched out mode in accordance with the fourth embodiment of the present invention.

The fourth embodiment will be described with refer to FIGS. 18, 19, 20 and 21. FIG. 18 depicts a perspective front view of the bicycle trainer (400) in the folded mode and FIG. 19 depicts that in the stretched out mode in accordance with the fourth embodiment of the present invention. FIG. 20 depicts a perspective back view of the bicycle trainer (400) in the folded mode and FIG. 21 depicts that in the stretched out mode in accordance with the fourth embodiment of the present invention. The element of the fourth embodiment which is the same or similar with that of the first, second or third embodiment will be given the same or similar symbol.

The bicycle trainer (400) comprises a cassette module (1), a flywheel module (2), a handle (3), an axle (4), a knob (5) with a locating pin (not shown), a base (6), legs (7), a supporting frame (8) and foots (9). The base (6) of the fourth embodiment is different from that of the first, second or third embodiment, which is mainly made by bended tubes or pipes consisted of metallic or composite material. The base (6) is a one-piece base (6) and can also define a base portion (62) and a standing portion (63). In some examples, the one-piece base (6) can have various shapes or sectional profiles including, for example, tubular, square, triangle, oval, diamond, etc. In some examples, the one-piece base (6) may be formed from multiple piece elements which are permanently combined into a one-piece base, for example, by welding or gluing, etc.

The composition and structure of the cassette module (1), the flywheel module (2), a height adjusting member, a tension adjustment mechanism of the fourth embodiment are the same with those of the second embodiment as shown in FIGS. 9, 10, 11, 12 and 13. Accordingly, the same description made to the same element of embodiment 2 is omitted here for simplicity.

Further, in the above embodiments, the handle (3) may be directly above the axle (4), and the cassette module (1) and the axle (10) may be diagonally above the axle (4). In some examples, the handle (3) is directly above the axle (4) both in the stretched out mode and the folded mode; in some examples, the handle (3) is directly above the axle (4) in only one mode of the stretched out mode and the folded mode, for example only in the stretched out mode or only in the folded mode. It is convenient for the user to operate with exertion of force when the handle (3) is directly above the axle (4). The user may use his/her one hand to operate the handle (3). The handle (3) is connected to and supported by the supporting frame (8). The rotation of the supporting frame (8) around the axle (4) caused by the handle (3) results in that the heights of the cassette module (1) and the axle (10) are varied accordingly, for example, lifted up or lowered down. Thus, the user may easily adjust the height of the cassette module (1) and the axle (10) and mount his/her own bicycle with the rear wheel been removed to the bicycle trainer (100) through the cassette module (1). For example, the user may operate the handle (3) by his/her one hand to adjust the heights of the cassette module (1) and the axle (10), and put the chain of the bicycle (the rear wheel has been removed) on the cassette module (1) by his/her the other hand so as to adjust the height to a desired height.

The foregoing embodiments of the invention have been presented for the purpose of exemplary or explanatory illustration. Although the invention has been described by certain preceding examples, it is not to be construed as being limited by them. They are not intended to be exhaustive, or to limit the scope of the invention. Modifications, improvements and variations within the scope of the invention are possible in light of this disclosure.

For example, the height adjusting member depicted set forth in the embodiments above may be applied not only to a bicycle trainer but also to any exercise apparatus, which, for example, comprises a base having a base portion and a standing portion; a supporting frame rotationally pivoted on the standing portion of the base around a first axle; a flywheel module pivotally mounted on the supporting frame around a second axle for simulating uphill and/or downhill cycling circumstance; and a height adjusting member, comprising the standing portion, the supporting frame and a fixing element, and the fixing element is placed in or between the standing portion and the supporting frame for keeping the supporting frame at a predetermined angle with respect to the standing portion.

What is claimed is:

1. A bicycle trainer, comprising:

a base having a base portion and a standing portion connected above the base portion;

at least one leg pivotally mounted on the base;

a supporting frame rotationally pivoted on the standing portion of the base around a first axle positioned above the base portion;

a cassette module mounted on the supporting frame and having multiple sprockets;

a flywheel module mounted on the supporting frame and being coaxial with the cassette module around a second axle; and a height adjusting member comprising the standing portion, the supporting frame and a fixing element, wherein the fixing element is a locating pin placed in the standing portion for keeping the supporting frame at a predetermined angle with respect to the standing portion.

2. The bicycle trainer of claim 1, wherein the standing portion has at least one aligning hole and the supporting frame has multiple locating holes, and wherein the at least one aligning hole and one of the multiple locating holes can receive the locating pin to keep the supporting frame at a predetermined angle with respect to the standing portion.

3. The bicycle trainer of claim 2, wherein the bicycle trainer further comprises a knob at one end of the locating pin.

4. The bicycle trainer of claim 2, wherein the standing portion has one aligning hole at one side of the standing portion and further has another aligning hole at the other side of the standing portion, and wherein the aligning holes and one of the multiple locating holes can receive the locating pin to keep the supporting frame at a predetermined angle with respect to the standing portion.

5. The bicycle trainer of claim 1, wherein the bicycle trainer further comprises a handle disposed at or near the top of the bicycle trainer when the bicycle trainer is in a folded mode.

6. The bicycle trainer of claim 1, wherein the bicycle trainer further comprises an electrical power source accommodated in the base and used to power up electrical components in the bicycle trainer.

7. The bicycle trainer of claim 1, wherein the flywheel module further comprises a dual mode motor simulating uphill and downhill cycling circumstance.

8. A bicycle trainer, comprising:

a base having a base portion and a standing portion connected above the base portion;

at least one leg pivotally mounted on the base;

a supporting frame rotationally pivoted on the standing portion of the base around a first axle positioned above the base portion;

a cassette module mounted on the supporting frame and having multiple sprockets and a cassette pulley, the cassette module rotates around a second axle;

a flywheel module mounted on the supporting frame and having a flywheel pulley, wherein the flywheel module rotates around the first axle;

a belt being around the cassette pulley and the flywheel pulley; and a height adjusting member, comprising the standing portion, the supporting frame and a fixing element, and wherein the fixing element is a locating pin placed in the standing portion for keeping the supporting frame at a predetermined angle with respect to the standing portion.

9. The bicycle trainer of claim 8, wherein the standing portion has at least one aligning hole and the supporting frame has multiple locating holes, and wherein the aligning hole and one of the multiple locating holes can receive the locating pin to keep the supporting frame at a predetermined angle with respect to the standing portion.

10. The bicycle trainer of claim 9, wherein the bicycle trainer further comprises a knob at one end of the locating pin.

11. The bicycle trainer of claim 9, wherein the standing portion has one aligning hole at one side of the standing portion and further has another aligning hole at the other side of the standing portion, and wherein the aligning holes and one of the multiple locating holes can receive the locating pin to keep the supporting frame at a predetermined angle with respect to the standing portion.

12. The bicycle trainer of claim 8, wherein the bicycle trainer further comprises a handle disposed at or near the top of the bicycle trainer when the bicycle trainer is in a folded mode.

13. The bicycle trainer of claim 8, wherein the bicycle trainer further comprises an electrical power source accommodated in the base and used to power up electrical components in the bicycle trainer.

14. The bicycle trainer of claim 8, wherein the flywheel module further comprises a magnetic resistance component simulating uphill cycling circumstance.

15. The bicycle trainer of claim 8, wherein the base is a one-piece base.

16. The bicycle trainer of claim 8, wherein the bicycle trainer further comprises a belt tension arm pivoted around the first axle, an idler pulley pivoted on the belt tension arm and a spring, and one end of the spring is connected to one end of the belt tension arm and the other end of the spring is connected to a housing of the supporting frame, and wherein a tension of the belt is automatically increased or decreased in response to an angle formed between the supporting frame and the standing portion.

17. The bicycle trainer of claim 16, wherein the flywheel pulley, the belt tension arm, the supporting frame and the flywheel module are rotationally co-pivoted around the first axle.

18. A bicycle trainer, comprising:

a base having a base portion and a standing portion;

at least one leg pivotally mounted on the base;

a supporting frame rotationally pivoted on the standing portion of the base around a first axle;

a cassette module mounted on the supporting frame and having multiple sprockets;

a flywheel module mounted on the supporting frame and being coaxial with the cassette module around a second axle; and a height adjusting member comprising the standing portion, the supporting frame and a fixing element, wherein the fixing element is placed in or between the standing portion and the supporting frame for keeping the supporting frame at a predetermined angle with respect to the standing portion;

wherein the fixing element is a pawl pivoted on the supporting frame, and wherein the standing portion has a ratchet part and the supporting frame has a spring coupled to the pawl, and wherein the pawl can engage with a teeth of the ratchet part to keep the supporting frame at a predetermined angle with respect to the standing portion.

19. A bicycle trainer, comprising:

a base having a base portion and a standing portion;

at least one leg pivotally mounted on the base;

a supporting frame rotationally pivoted on the standing portion of the base around a first axle;

a cassette module mounted on the supporting frame and having multiple sprockets and a cassette pulley, the cassette module rotates around a second axle;

a flywheel module mounted on the supporting frame and having a flywheel pulley, wherein the flywheel module rotates around the first axle;

a belt being around the cassette pulley and the flywheel pulley; and a height adjusting member, comprising the standing portion, the supporting frame and a fixing element, and wherein the fixing element is placed in or between the standing portion and the supporting frame for keeping the supporting frame at a predetermined angle with respect to the standing portion;

wherein the fixing element is a pawl pivoted on the supporting frame, and wherein the standing portion has a ratchet part and the supporting frame has a spring coupled to the pawl, and wherein the pawl can engage with a teeth of the ratchet part to keep the supporting frame at a predetermined angle with respect to the standing portion.

* * * * *